US010835911B2

(12) United States Patent
Gehrung et al.

(10) Patent No.: US 10,835,911 B2
(45) Date of Patent: Nov. 17, 2020

(54) TRIGGER FOR A SPRAY GUN AND SPRAY GUN HAVING SAME

(71) Applicant: SATA GmbH & Co. KG, Kornwestheim (DE)

(72) Inventors: Ralf Gehrung, Backnang (DE); Detlef Redecker, Denkendorf (DE)

(73) Assignee: SATA GMBH & CO. KG, Kornwestheim (DE)

( * ) Notice: Subject to any disclaimer, the term of this patent is extended or adjusted under 35 U.S.C. 154(b) by 0 days.

(21) Appl. No.: 15/679,461

(22) Filed: Aug. 17, 2017

(65) Prior Publication Data

US 2018/0050362 A1 Feb. 22, 2018

(30) Foreign Application Priority Data

Aug. 19, 2016 (CN) ..... 2016 2 0913023 U

(51) Int. Cl.

| | |
|---|---|
| ***B05B 7/02*** | (2006.01) |
| ***B05B 12/00*** | (2018.01) |
| *B05B 1/30* | (2006.01) |
| *B05B 7/24* | (2006.01) |

(52) U.S. Cl.

CPC ..... *B05B 12/002* (2013.01); *B05B 1/3046* (2013.01); *B05B 7/02* (2013.01); *B05B 7/2478* (2013.01)

(58) Field of Classification Search

CPC ..... B05B 12/008; B05B 1/306; B05B 12/002; B05B 1/3046; B05B 7/02; B05B 7/2478; B05B 15/00

USPC ..... 239/526

See application file for complete search history.

(56) References Cited

U.S. PATENT DOCUMENTS

| | | | |
|---|---|---|---|
| 40,433 | A | 10/1863 | Sees |
| 327,260 | A | 9/1885 | Hart |
| 459,432 | A | 9/1891 | Anderson |
| 459,433 | A | 9/1891 | Avery |
| 548,816 | A | 10/1895 | Paul |
| 552,213 | A | 12/1895 | Troy |
| 552,715 | A | 1/1896 | Lugrin |
| 563,505 | A | 7/1896 | McCornack |
| 581,107 | A | 4/1897 | Emery |

(Continued)

FOREIGN PATENT DOCUMENTS

| | | |
|---|---|---|
| AT | 153883 | 6/1997 |
| AT | 163577 | 3/1998 |

(Continued)

OTHER PUBLICATIONS

Restriction Requirement Office Action dated Apr. 17, 2017 for U.S. Appl. No. 14/815,210.

(Continued)

*Primary Examiner* — Chee-Chong Lee

(74) *Attorney, Agent, or Firm* — Paul D. Bianco; Gary S. Winer; Fleit Intellectual Property Law

(57) ABSTRACT

A spray gun and a trigger for the same. A one-armed trigger for a spray gun comprises a single connecting arm, secured to a left side or a right side of a spray gun body of the spray gun; an operating portion, provided at a lower end of the connecting arm; and an actuating component, provided on the connecting arm. The trigger can be more easily and reliably assembled onto a spray gun body and reduce the possibility of damaging parts of the spray gun.

20 Claims, 12 Drawing Sheets

(56) References Cited

U.S. PATENT DOCUMENTS

| | | | |
|---|---|---|---|
| 644,803 | A | 3/1900 | Justi |
| 672,012 | A | 4/1901 | Ruper |
| 574,880 | A | 5/1901 | Schmidt et al. |
| 1,662,496 | A | 3/1928 | Forsgard |
| 1,703,383 | A | 2/1929 | Birkenmaier |
| 1,703,384 | A | 2/1929 | Birkenmaier |
| 1,711,221 | A | 4/1929 | Blakeslee |
| 1,751,787 | A | 3/1930 | Binks |
| 1,889,201 | A | 11/1932 | Holveck |
| 2,004,303 | A | 6/1935 | Wahlin |
| 2,008,381 | A | 7/1935 | Beeg |
| 2,049,700 | A | 8/1936 | Gustafsson |
| 2,051,210 | A | 8/1936 | Gustafsson |
| 2,070,696 | A | 2/1937 | Tracy |
| 2,116,036 | A | 5/1938 | Money |
| 2,198,441 | A | 4/1940 | Lobegott |
| 2,204,599 | A | 6/1940 | Jenkins |
| 2,269,057 | A | 1/1942 | Jenkins |
| D133,223 | S | 7/1942 | Tammen |
| 2,356,865 | A | 8/1944 | Mason |
| 2,416,856 | A | 3/1947 | Thomsen |
| 2,416,923 | A | 3/1947 | Jenkins |
| 2,557,593 | A | 6/1951 | Bjorkman |
| 2,557,606 | A | 6/1951 | Liedberg |
| 2,559,091 | A | 7/1951 | Reasenberg |
| 2,609,961 | A | 9/1952 | Sapien |
| 2,612,899 | A | 10/1952 | Webb |
| 2,646,314 | A | 7/1953 | Peeps |
| 2,721,004 | A | 10/1955 | Schultz |
| 2,743,963 | A | 5/1956 | Peeps |
| 2,844,267 | A | 7/1958 | Petriccione |
| 2,886,252 | A | 5/1959 | Ehrensperger |
| 3,090,530 | A | 5/1963 | Peeps |
| D196,477 | S | 10/1963 | Kelly |
| 3,159,472 | A | 12/1964 | Revell |
| D200,594 | S | 3/1965 | Sass |
| 3,240,398 | A | 3/1966 | Dalton, Jr. |
| D204,306 | S | 4/1966 | Hamm |
| D205,760 | S | 9/1966 | Hocutt et al. |
| D208,903 | S | 10/1967 | Zadron et al. |
| 3,344,992 | A | 10/1967 | Norris |
| 3,381,845 | A | 5/1968 | MacDonald |
| 3,420,106 | A | 1/1969 | Keller et al. |
| 3,435,683 | A | 4/1969 | Keller et al. |
| 3,482,781 | A | 12/1969 | Sharpe |
| D217,928 | S | 6/1970 | Felske |
| 3,524,589 | A | 8/1970 | Pelton, Jr. |
| 3,527,372 | A | 9/1970 | Manning |
| 3,622,078 | A | 11/1971 | Gronert |
| 3,645,562 | A | 2/1972 | Fandetti et al. |
| 3,656,493 | A | 4/1972 | Black et al. |
| 3,714,967 | A | 2/1973 | Zupan et al. |
| 3,771,539 | A | 11/1973 | De Santis |
| 3,840,143 | A | 10/1974 | Davis et al. |
| 3,848,807 | A | 11/1974 | Partida |
| 3,870,223 | A | 3/1975 | Wyant |
| 3,938,739 | A | 2/1976 | Bertilsson et al. |
| 4,000,915 | A | 1/1977 | Strom |
| D245,048 | S | 7/1977 | Pool |
| D252,097 | S | 6/1979 | Probst et al. |
| 4,160,525 | A | 7/1979 | Wagner |
| 4,171,091 | A | 10/1979 | van Hardeveld et al. |
| 4,210,263 | A | 7/1980 | Bos |
| 4,273,293 | A | 6/1981 | Hastings |
| 4,278,276 | A | 7/1981 | Ekman |
| 4,411,387 | A | 10/1983 | Stern et al. |
| 4,478,370 | A | 10/1984 | Hastings |
| D276,472 | S | 11/1984 | Harrison |
| D278,543 | S | 4/1985 | Gintz |
| 4,545,536 | A | 10/1985 | Avidon |
| 4,562,965 | A | 1/1986 | Ihmels et al. |
| 4,572,437 | A | 2/1986 | Huber et al. |
| 4,580,035 | A | 4/1986 | Luscher |
| 4,585,168 | A | 4/1986 | Even et al. |
| 4,614,300 | A | 9/1986 | Falcoff |
| 4,643,330 | A | 2/1987 | Kennedy |
| 4,653,661 | A | 3/1987 | Buchner et al. |
| 4,667,878 | A | 5/1987 | Behr |
| 4,713,257 | A | 12/1987 | Luttermoeller |
| D293,950 | S | 1/1988 | Ogden et al. |
| 4,730,753 | A | 3/1988 | Grime |
| 4,767,057 | A | 8/1988 | Degli et al. |
| D298,372 | S | 11/1988 | Taylor, Jr. |
| 4,784,184 | A | 11/1988 | Gates |
| 4,806,736 | A | 2/1989 | Schirico |
| 4,826,539 | A | 5/1989 | Harpold |
| 4,832,232 | A | 5/1989 | Broccoli |
| 4,863,781 | A | 9/1989 | Kronzer |
| 4,877,144 | A | 10/1989 | Thanisch |
| D305,057 | S | 12/1989 | Morgan |
| 4,887,747 | A | 12/1989 | Ostrowsky et al. |
| 4,901,761 | A | 2/1990 | Taylor |
| 4,906,151 | A | 3/1990 | Kubis |
| 4,917,300 | A | 4/1990 | Gloviak et al. |
| 4,946,075 | A | 8/1990 | Lundback |
| 4,964,361 | A | 10/1990 | Aebersold |
| 4,967,600 | A | 11/1990 | Keller |
| 4,969,603 | A | 11/1990 | Norman |
| 4,973,184 | A | 11/1990 | La Salle |
| D314,421 | S | 2/1991 | Tajima et al. |
| D314,588 | S | 2/1991 | Denham |
| 4,989,787 | A | 2/1991 | Nikkel et al. |
| 5,020,700 | A | 6/1991 | Krzywdziak et al. |
| D318,877 | S | 8/1991 | Miranda et al. |
| 5,042,840 | A | 8/1991 | Rieple et al. |
| D321,597 | S | 11/1991 | Cerny |
| 5,071,074 | A | 12/1991 | Lind |
| 5,074,334 | A | 12/1991 | Onodera |
| 5,088,648 | A | 2/1992 | Schmon |
| 5,102,045 | A | 4/1992 | Diana |
| 5,119,992 | A | 6/1992 | Grime |
| 5,125,391 | A | 6/1992 | Srivastava et al. |
| 5,135,124 | A | 8/1992 | Wobser |
| 5,143,102 | A | 9/1992 | Blaul |
| 5,165,605 | A | 11/1992 | Morita et al. |
| 5,170,941 | A | 12/1992 | Morita et al. |
| 5,190,219 | A | 3/1993 | Copp, Jr. |
| 5,191,797 | A | 3/1993 | Smith |
| 5,209,405 | A | 5/1993 | Robinson et al. |
| 5,228,488 | A | 7/1993 | Fletcher |
| 5,232,299 | A | 8/1993 | Hiss |
| 5,236,128 | A | 8/1993 | Morita et al. |
| 5,249,746 | A | 10/1993 | Kaneko et al. |
| D341,186 | S | 11/1993 | Albers |
| 5,289,974 | A | 3/1994 | Grime et al. |
| 5,322,221 | A | 6/1994 | Anderson |
| 5,325,473 | A | 6/1994 | Monroe et al. |
| 5,332,156 | A | 7/1994 | Wheeler |
| 5,333,506 | A | 8/1994 | Smith et al. |
| 5,333,908 | A | 8/1994 | Dorney et al. |
| 5,344,078 | A | 9/1994 | Fritz et al. |
| 5,367,148 | A | 11/1994 | Storch et al. |
| D353,836 | S | 12/1994 | Carvelli et al. |
| 5,381,962 | A | 1/1995 | Teague |
| 5,435,491 | A | 7/1995 | Sakuma |
| 5,443,642 | A | 8/1995 | Bienduga |
| 5,456,414 | A | 10/1995 | Burns et al. |
| D365,952 | S | 1/1996 | Gagnon et al. |
| 5,503,439 | A | 4/1996 | LaJeunesse et al. |
| 5,529,245 | A | 6/1996 | Brown |
| 5,533,674 | A | 7/1996 | Feyrer et al. |
| 5,540,385 | A | 7/1996 | Garlick |
| 5,540,386 | A | 7/1996 | Roman |
| D376,637 | S | 12/1996 | Kieffer |
| 5,582,350 | A | 12/1996 | Kosmyna et al. |
| 5,584,899 | A | 12/1996 | Shorts |
| 5,588,562 | A | 12/1996 | Sander et al. |
| 5,592,597 | A | 1/1997 | Kiss |
| 5,609,302 | A | 3/1997 | Smith |
| 5,613,637 | A | 3/1997 | Schmon |
| D380,301 | S | 7/1997 | Kogutt |
| 5,655,714 | A | 8/1997 | Kieffer et al. |
| 5,662,444 | A | 9/1997 | Schmidt, Jr. |
| 5,667,143 | A | 9/1997 | Sebion et al. |

(56) References Cited

U.S. PATENT DOCUMENTS 5,695,125 A 12/1997 Kumar
5,704,381 A 1/1998 Millan et al.
5,718,767 A 2/1998 Crum et al.
D391,403 S 3/1998 Josephs
5,725,161 A 3/1998 Hartle
RE35,769 E 4/1998 Grime et al.
5,755,363 A 5/1998 Gantner et al.
5,762,228 A 6/1998 Morgan et al.
5,803,360 A 9/1998 Spitznagel
5,816,501 A 10/1998 LoPresti et al.
5,836,517 A 11/1998 Burns et al.
D402,820 S 12/1998 Morison et al.
5,843,515 A 12/1998 Crum et al.
5,853,014 A 12/1998 Rosenauer
D405,503 S 2/1999 Endo
5,874,680 A 2/1999 Moore
5,884,006 A 3/1999 Frohlich et al.
D409,719 S 5/1999 Kaneko
5,951,190 A 9/1999 Wilson
5,951,296 A 9/1999 Klein
5,954,268 A 9/1999 Joshi et al.
D414,636 S 10/1999 Wiese
5,979,797 A 11/1999 Castellano
6,006,930 A 12/1999 Dreyer et al.
6,010,082 A 1/2000 Peterson
6,017,394 A 1/2000 Crum et al.
6,019,294 A 2/2000 Anderson et al.
6,036,109 A 3/2000 DeYoung
6,039,218 A 3/2000 Beck
6,053,429 A 4/2000 Chang
6,056,213 A 5/2000 Ruta et al.
6,089,471 A 7/2000 Scholl
6,089,607 A 7/2000 Keeney et al.
6,091,053 A 7/2000 Aonuma
6,092,740 A 7/2000 Liu
6,132,511 A 10/2000 Crum et al.
D435,379 S 12/2000 Nguyen
6,230,986 B1 5/2001 Vacher et al.
6,250,567 B1 6/2001 Lewis et al.
6,267,301 B1 7/2001 Haruch
6,276,616 B1 8/2001 Jenkins
D448,451 S 9/2001 Turnbull et al.
6,308,991 B1 10/2001 Royer
D457,599 S 5/2002 Karwoski
D459,432 S 6/2002 Schmon
D459,433 S 6/2002 Schmon
6,402,058 B2 6/2002 Kaneko et al.
6,431,466 B1 8/2002 Kitajima
6,435,426 B1 8/2002 Copp, Jr.
6,442,276 B1 8/2002 Doljack
6,450,422 B1 9/2002 Maggio
6,494,387 B1 12/2002 Kaneko
6,536,684 B1 3/2003 Wei
6,536,687 B1 3/2003 Navis et al.
D472,730 S 4/2003 Sparkowski
6,540,114 B1 4/2003 Popovich et al.
6,543,632 B1 4/2003 McIntyre et al.
6,547,884 B1 4/2003 Crum et al.
6,553,712 B1 4/2003 Majerowski et al.
6,554,009 B1 4/2003 Beijbom et al.
D474,528 S 5/2003 Huang
6,585,173 B2 7/2003 Schmon et al.
6,595,441 B2 7/2003 Petrie et al.
6,612,506 B1 9/2003 Huang
6,626,382 B1 9/2003 Liu
6,626,383 B1 9/2003 Campbell
6,647,997 B2 11/2003 Mohn
6,661,438 B1 12/2003 Shiraishi et al.
D485,685 S 1/2004 Zupkofska et al.
6,675,845 B2 1/2004 Volpenheim et al.
6,692,118 B2 2/2004 Michele et al.
6,712,292 B1 3/2004 Gosis et al.
6,717,584 B2 4/2004 Kulczycka
6,732,751 B2 5/2004 Chiang
6,763,964 B1 7/2004 Hurlbut et al.
6,766,763 B2 7/2004 Crum et al.
6,786,345 B2 9/2004 Richards
6,796,514 B1 9/2004 Schwartz
6,801,211 B2 10/2004 Forsline et al.
6,820,824 B1 11/2004 Joseph et al.
6,843,390 B1 1/2005 Bristor
6,845,924 B2 1/2005 Schmon
6,855,173 B2 2/2005 Ehrnsperger et al.
6,863,310 B1 3/2005 Petkovsek
6,863,920 B2 3/2005 Crum et al.
6,874,656 B2 4/2005 Rohr et al.
6,874,664 B1 4/2005 Montgomery
6,874,708 B2 4/2005 Reetz, III
6,877,677 B2 4/2005 Schmon et al.
6,929,019 B2 8/2005 Weinmann et al.
6,945,429 B2 9/2005 Gosis et al.
6,955,180 B2 10/2005 Kocherlakota et al.
6,962,432 B2 11/2005 Hofeldt
6,963,331 B1 11/2005 Kobayashi et al.
7,017,838 B2 3/2006 Schmon
7,018,154 B2 3/2006 Schmon
D519,687 S 4/2006 Zahav
7,032,839 B2 4/2006 Biette
7,036,752 B1 5/2006 Hsiang
7,083,119 B2 8/2006 Bouic et al.
7,090,148 B2 8/2006 Petrie et al.
7,097,118 B1 8/2006 Huang
D528,192 S 9/2006 Nicholson
7,106,343 B1 9/2006 Hickman
7,165,732 B2 1/2007 Kosmyna et al.
7,172,139 B2 2/2007 Bouic et al.
7,175,110 B2 2/2007 Vicentini
7,182,213 B2 2/2007 King
D538,050 S 3/2007 Tardif
D538,493 S 3/2007 Zimmerle et al.
D538,886 S 3/2007 Huang
7,194,829 B2 3/2007 Boire et al.
D541,053 S 4/2007 Sanders
D541,088 S 4/2007 Nesci
7,201,336 B2 4/2007 Blette et al.
7,216,813 B2 5/2007 Rogers
D545,943 S 7/2007 Rodgers et al.
7,246,713 B2 7/2007 King
7,249,519 B2 7/2007 Rogers
D548,816 S 8/2007 Schmon
7,255,293 B2 8/2007 Dodd
7,264,131 B2 9/2007 Tsutsumi et al.
D552,213 S 10/2007 Schmon
D552,715 S 10/2007 Schmon
D554,703 S 11/2007 Josephson
D563,505 S 3/2008 Schmon
7,374,111 B2 5/2008 Joseph et al.
D571,463 S 6/2008 Chesnin
7,384,004 B2 6/2008 Rogers
RE40,433 E 7/2008 Schmon
D573,227 S 7/2008 Mirazita et al.
D574,926 S 8/2008 Huang
D575,374 S 8/2008 Huang
7,410,106 B2 8/2008 Escoto, Jr. et al.
7,416,140 B2 8/2008 Camilleri et al.
7,422,164 B2 9/2008 Matsumoto
D579,213 S 10/2008 Aipa
D581,107 S 11/2008 Schmon
D581,483 S 11/2008 Bass et al.
D583,013 S 12/2008 Wang
7,458,612 B1 12/2008 Bennett
D588,231 S 3/2009 Pellin
7,533,678 B2 5/2009 Rosa
7,540,434 B2 6/2009 Gohring et al.
7,542,032 B2 6/2009 Kruse
7,568,638 B2 8/2009 Gehrung
D604,394 S 11/2009 Wang
7,614,571 B2 11/2009 Camilleri et al.
D607,086 S 12/2009 Kosaka
7,624,869 B2 12/2009 Primer
D607,972 S 1/2010 Wang
D608,858 S 1/2010 Baltz et al.
D614,731 S 4/2010 Wang
7,694,893 B2 4/2010 Zittel et al.

(56) References Cited

U.S. PATENT DOCUMENTS

| | | | |
|---|---|---|---|
| 7,694,896 | B2 | 4/2010 | Turnbull et al. |
| D615,586 | S | 5/2010 | Kudimi |
| D616,022 | S | 5/2010 | Kudimi |
| D616,527 | S | 5/2010 | Anderson et al. |
| 7,765,876 | B1 | 8/2010 | Chen |
| D624,668 | S | 9/2010 | Noppe |
| 7,810,744 | B2 | 10/2010 | Schmon et al. |
| 7,819,341 | B2 | 10/2010 | Schmon et al. |
| D627,039 | S | 11/2010 | Yu |
| D627,432 | S | 11/2010 | Escoto et al. |
| 7,823,806 | B2 | 11/2010 | Schmon |
| D629,623 | S | 12/2010 | Lampe |
| 7,856,940 | B2 | 12/2010 | Wendler |
| 7,913,938 | B2 | 3/2011 | Cooper |
| 7,922,107 | B2 | 4/2011 | Fox |
| D637,269 | S | 5/2011 | Wang |
| D638,121 | S | 5/2011 | Villasana |
| D639,863 | S | 6/2011 | Langan |
| D641,067 | S | 7/2011 | Wang |
| D644,716 | S | 9/2011 | Gehrung |
| D644,803 | S | 9/2011 | Schmon |
| D645,094 | S | 9/2011 | Langan |
| 8,042,402 | B2 | 10/2011 | Brown et al. |
| D649,196 | S | 11/2011 | Langan |
| 8,052,071 | B2 | 11/2011 | Kruse |
| D655,347 | S | 3/2012 | Gehrung |
| 8,127,963 | B2 | 3/2012 | Gerson et al. |
| D657,276 | S | 4/2012 | Brose |
| D661,492 | S | 6/2012 | Ranschau |
| D661,742 | S | 6/2012 | Clark |
| D663,960 | S | 7/2012 | Jeronimo |
| 8,225,892 | B2 | 7/2012 | Ben-Tzvi |
| D664,773 | S | 8/2012 | Papin |
| 8,240,579 | B1 | 8/2012 | Bennett |
| 8,297,536 | B2 | 10/2012 | Ruda |
| D670,085 | S | 11/2012 | Brookman |
| D671,988 | S | 12/2012 | Leipold |
| D672,012 | S | 12/2012 | Brose |
| D674,880 | S | 1/2013 | Schmon |
| 8,352,744 | B2 | 1/2013 | Kruse |
| 8,360,345 | B2 | 1/2013 | Micheli |
| D681,162 | S | 4/2013 | Kruse |
| 8,444,067 | B2 | 5/2013 | Schmon et al. |
| 8,454,759 | B2 | 6/2013 | Selsvik |
| 8,481,124 | B2 | 7/2013 | Nolte et al. |
| D689,590 | S | 9/2013 | Brose |
| D689,593 | S | 9/2013 | Schmon |
| D690,799 | S | 10/2013 | Maier |
| D692,530 | S | 10/2013 | Gehrung |
| D692,532 | S | 10/2013 | Li et al. |
| 8,616,434 | B2 | 12/2013 | Wilen |
| D697,584 | S | 1/2014 | Schmon |
| D698,008 | S | 1/2014 | Schmon et al. |
| 8,626,674 | B2 | 1/2014 | Whitehouse |
| 8,642,131 | B2 | 2/2014 | Nolte et al. |
| D704,300 | S | 5/2014 | Li |
| 8,757,182 | B2 | 6/2014 | Schmon |
| 8,807,460 | B2 | 8/2014 | Charpie et al. |
| 8,857,732 | B2 | 10/2014 | Brose |
| D720,015 | S | 12/2014 | Kruse |
| D720,041 | S | 12/2014 | Robinson |
| 8,899,501 | B2 | 12/2014 | Fox et al. |
| D721,785 | S | 1/2015 | Gehrung |
| 8,925,836 | B2 | 1/2015 | Dettlaff |
| D733,369 | S | 6/2015 | Tschan |
| D733,453 | S | 7/2015 | Tschan |
| D734,428 | S | 7/2015 | Wang |
| D734,429 | S | 7/2015 | Wang |
| D734,571 | S | 7/2015 | Tschan |
| 9,073,068 | B2 | 7/2015 | Krayer et al. |
| D745,636 | S | 12/2015 | Lin |
| 9,220,853 | B2 | 12/2015 | Vogt |
| D757,216 | S | 5/2016 | Gherung |
| D758,533 | S | 6/2016 | Dettlaff |
| D758,537 | S | 6/2016 | Gehrung |
| D768,820 | S | 10/2016 | Binz |
| D770,593 | S | 11/2016 | Gehrung |
| 9,533,317 | B2 | 1/2017 | Gehrung et al. |
| D792,557 | S | 7/2017 | Wang |
| D794,756 | S | 8/2017 | Wang |
| 9,782,784 | B2 | 10/2017 | Schmon et al. |
| 9,878,336 | B2 | 1/2018 | Gehrung |
| D835,235 | S | 12/2018 | Gehrung et al. |
| 10,189,037 | B2 | 1/2019 | Schmon et al. |
| 10,471,449 | B2 | 11/2019 | Gehrung |
| 2001/0004996 | A1 | 6/2001 | Schmon |
| 2001/0040192 | A1 | 11/2001 | Kaneko et al. |
| 2002/0134861 | A1 | 9/2002 | Petrie et al. |
| 2002/0148501 | A1 | 10/2002 | Shieh |
| 2002/0170978 | A1 | 11/2002 | Mohn |
| 2003/0025000 | A1 | 2/2003 | Schmon et al. |
| 2003/0066218 | A1 | 4/2003 | Schweikert |
| 2003/0121476 | A1 | 7/2003 | McIntyre et al. |
| 2003/0127046 | A1 | 7/2003 | Zehner et al. |
| 2003/0164408 | A1 | 9/2003 | Schmon |
| 2003/0173419 | A1 | 9/2003 | Huang |
| 2003/0177979 | A1 | 9/2003 | Crum et al. |
| 2003/0189105 | A1 | 10/2003 | Schmon |
| 2003/0209568 | A1 | 11/2003 | Douglas et al. |
| 2003/0213857 | A1 | 11/2003 | Schmon et al. |
| 2003/0218596 | A1 | 11/2003 | Eschler |
| 2003/0230636 | A1 | 12/2003 | Rogers |
| 2004/0046051 | A1 | 3/2004 | Santa Cruz et al. |
| 2004/0050432 | A1 | 3/2004 | Breda |
| 2004/0104194 | A1 | 6/2004 | Dennison |
| 2004/0129738 | A1 | 7/2004 | Stukas |
| 2004/0140373 | A1 | 7/2004 | Joseph et al. |
| 2004/0155063 | A1 | 8/2004 | Hofeldt |
| 2004/0159720 | A1 | 8/2004 | Komornicki |
| 2004/0177890 | A1 | 9/2004 | Weinmann |
| 2004/0191406 | A1 | 9/2004 | Crum et al. |
| 2004/0217201 | A1 | 11/2004 | Ruda |
| 2004/0233223 | A1 | 11/2004 | Schkolne et al. |
| 2004/0245208 | A1 | 12/2004 | Dennison |
| 2005/0056613 | A1 | 3/2005 | King |
| 2005/0082249 | A1 | 4/2005 | King |
| 2005/0127201 | A1 | 6/2005 | Matsumoto |
| 2005/0145723 | A1 | 7/2005 | Blette et al. |
| 2005/0145724 | A1 | 7/2005 | Blette et al. |
| 2005/0178854 | A1 | 8/2005 | Dodd |
| 2005/0189445 | A1 | 9/2005 | Hartle et al. |
| 2005/0218246 | A1 | 10/2005 | Chatron et al. |
| 2005/0220943 | A1 | 10/2005 | Abrams et al. |
| 2005/0248148 | A1 | 11/2005 | Schenck et al. |
| 2005/0252993 | A1 | 11/2005 | Rogers |
| 2005/0252994 | A1 | 11/2005 | Rogers |
| 2005/0268949 | A1 | 12/2005 | Rosa |
| 2005/0284963 | A1 | 12/2005 | Reedy |
| 2006/0000927 | A1 | 1/2006 | Ruda |
| 2006/0007123 | A1 | 1/2006 | Wilson et al. |
| 2006/0048803 | A1 | 3/2006 | Jessup et al. |
| 2006/0081060 | A1 | 4/2006 | Forster |
| 2006/0113409 | A1 | 6/2006 | Camilleri et al. |
| 2006/0171771 | A1 | 8/2006 | Kruse |
| 2006/0192377 | A1 | 8/2006 | Bauer et al. |
| 2006/0196891 | A1 | 9/2006 | Gerson et al. |
| 2007/0029788 | A1 | 2/2007 | Adler |
| 2007/0055883 | A1 | 3/2007 | Kruse |
| 2007/0131795 | A1 | 6/2007 | Abbate et al. |
| 2007/0158349 | A1 | 7/2007 | Schmon et al. |
| 2007/0205305 | A1 | 9/2007 | Vagedes |
| 2007/0221754 | A1 | 9/2007 | Gehrung |
| 2007/0252378 | A1 | 11/2007 | Chambers |
| 2007/0262169 | A1 | 11/2007 | Wang |
| 2008/0011879 | A1 | 1/2008 | Gerson et al. |
| 2008/0019789 | A1 | 1/2008 | Dunaway et al. |
| 2008/0029619 | A1 | 2/2008 | Gohring et al. |
| 2008/0128533 | A1 | 6/2008 | Gehrung |
| 2008/0179763 | A1 | 7/2008 | Schmon et al. |
| 2008/0251977 | A1 | 10/2008 | Naruse et al. |
| 2008/0264892 | A1 | 10/2008 | Nozawa |
| 2008/0272213 | A1 | 11/2008 | Ting |
| 2008/0296410 | A1 | 12/2008 | Carey et al. |
| 2009/0014557 | A1 | 1/2009 | Schmon et al. |

(56) References Cited

U.S. PATENT DOCUMENTS

| | | | |
|---|---|---|---|
| 2009/0026290 | A1 | 1/2009 | Fox |
| 2009/0045623 | A1 | 2/2009 | Schmon |
| 2009/0072050 | A1 | 3/2009 | Ruda |
| 2009/0078789 | A1 | 3/2009 | Kruse |
| 2009/0078790 | A1 | 3/2009 | Camilleri et al. |
| 2009/0143745 | A1 | 6/2009 | Langan et al. |
| 2009/0183516 | A1 | 7/2009 | Appler et al. |
| 2009/0235864 | A1 | 9/2009 | Khoury et al. |
| 2009/0266915 | A1 | 10/2009 | Fedorov |
| 2010/0021646 | A1 | 1/2010 | Nolte et al. |
| 2010/0059533 | A1 | 3/2010 | Unger et al. |
| 2010/0084493 | A1 | 4/2010 | Troudt |
| 2010/0108783 | A1 | 5/2010 | Joseph et al. |
| 2010/0126541 | A1 | 5/2010 | Schmon |
| 2010/0163649 | A1 | 7/2010 | Bass et al. |
| 2010/0206963 | A1 | 8/2010 | Huang |
| 2010/0270390 | A1 | 10/2010 | Reitz |
| 2010/0270400 | A1 | 10/2010 | Evar et al. |
| 2011/0024524 | A1 | 2/2011 | Fox |
| 2011/0121103 | A1* | 5/2011 | Carleton ..... B05B 7/0081 239/337 |
| 2011/0125607 | A1 | 5/2011 | Wilen |
| 2011/0168811 | A1 | 7/2011 | Fox et al. |
| 2011/0174901 | A1 | 7/2011 | Dettlaff et al. |
| 2012/0012671 | A1 | 1/2012 | Brose et al. |
| 2012/0097762 | A1 | 4/2012 | Gehrung et al. |
| 2012/0132550 | A1 | 5/2012 | Gerson et al. |
| 2012/0160935 | A1 | 6/2012 | Krayer et al. |
| 2012/0187220 | A1 | 7/2012 | Micheli et al. |
| 2013/0056556 | A1 | 3/2013 | Schmon et al. |
| 2013/0074864 | A1 | 3/2013 | Nuzzo et al. |
| 2013/0266734 | A1 | 10/2013 | Nolte et al. |
| 2013/0320110 | A1 | 12/2013 | Brose et al. |
| 2014/0034757 | A1 | 2/2014 | Kaneko et al. |
| 2014/0048627 | A1 | 2/2014 | Schmon et al. |
| 2014/0059905 | A1 | 3/2014 | Raming |
| 2014/0145003 | A1 | 5/2014 | Schmon et al. |
| 2014/0263686 | A1 | 9/2014 | Hedger |
| 2014/0305962 | A1 | 10/2014 | Tschan |
| 2015/0165463 | A1 | 6/2015 | Gehrung |
| 2015/0231655 | A1 | 8/2015 | Adams et al. |
| 2016/0030960 | A1 | 2/2016 | Gehrung |
| 2017/0304852 | A1 | 10/2017 | Bierie |
| 2018/0050355 | A1 | 2/2018 | Delsard |
| 2018/0050356 | A1 | 2/2018 | Gehrung |
| 2018/0050361 | A1 | 2/2018 | Gehrung |
| 2018/0050362 | A1 | 2/2018 | Gehrung et al. |
| 2018/0133727 | A1 | 5/2018 | Schmon et al. |
| 2018/0200740 | A1 | 7/2018 | Rossbach et al. |
| 2020/0038889 | A1 | 2/2020 | Volk et al. |
| 2020/0038892 | A1 | 2/2020 | Volk et al. |

FOREIGN PATENT DOCUMENTS

| | | | |
|---|---|---|---|
| AT | 250467 | | 10/2003 |
| AT | 322645 | | 4/2006 |
| AT | 383910 | | 2/2008 |
| AT | 461752 | | 4/2010 |
| AT | 461753 | | 4/2010 |
| AT | 475488 | | 8/2010 |
| AU | 637187 | | 5/1993 |
| AU | 2002352235 | | 9/2003 |
| AU | 2004315547 | | 8/2005 |
| AU | 2005205899 | | 8/2005 |
| AU | 2011257605 | | 11/2012 |
| AU | 2011361295 | | 5/2013 |
| CA | 521511 | | 2/1956 |
| CA | 2126957 | | 1/1995 |
| CA | 2277096 | | 7/1998 |
| CA | 2445183 | | 10/2002 |
| CA | 2552390 | | 8/2005 |
| CA | 2555607 | | 8/2005 |
| CA | 2690112 | | 5/2009 |
| CA | 2797990 | | 12/2011 |
| CA | 2812684 | | 9/2012 |
| CA | 102917803 | | 2/2013 |
| CA | 2850401 | A1 | 5/2013 |
| CH | 203 668 | | 6/1939 |
| CH | 542104 | A | 9/1973 |
| CH | 676208 | | 12/1990 |
| CN | 2136077 | Y | 6/1993 |
| CN | 1899704 | A | 1/2007 |
| CN | 1902002 | | 1/2007 |
| CN | 1909970 | | 2/2007 |
| CN | 1909971 | | 2/2007 |
| CN | 1917960 | | 2/2007 |
| CN | 200954482 | | 10/2007 |
| CN | 101125316 | | 2/2008 |
| CN | 201064746 | Y | 5/2008 |
| CN | 100430150 | | 11/2008 |
| CN | 100455360 | | 1/2009 |
| CN | 101367066 | | 2/2009 |
| CN | 100478080 | | 4/2009 |
| CN | 101646500 | | 2/2010 |
| CN | 102211070 | | 4/2011 |
| CN | 102139249 | A | 8/2011 |
| CN | 102211069 | | 10/2011 |
| CN | 103 521 378 | A | 1/2014 |
| CN | 203508251 | U | 4/2014 |
| CN | 203737474 | U | 7/2014 |
| CN | 204074345 | U | 1/2015 |
| CN | 204294401 | U | 4/2015 |
| CN | 205966208 | U | 2/2017 |
| CN | 107427851 | A | 12/2017 |
| CN | 108223901 | A | 6/2018 |
| DE | 460381 | | 5/1928 |
| DE | 510362 | | 10/1930 |
| DE | 611325 | C | 3/1935 |
| DE | 1425890 | | 11/1968 |
| DE | 2559036 | | 9/1976 |
| DE | 2653981 | | 6/1978 |
| DE | 2950341 | | 7/1980 |
| DE | 2926286 | A1 | 1/1981 |
| DE | 3016419 | | 11/1981 |
| DE | 8024829.9 | | 9/1982 |
| DE | 3111571 | A1 | 10/1982 |
| DE | 3238149 | A1 | 4/1984 |
| DE | 34 02 097 | | 8/1985 |
| DE | 3402945 | A1 | 8/1985 |
| DE | 3517122 | | 5/1986 |
| DE | 3505618 | | 8/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 3742308 | | 6/1989 |
| DE | 8905681 | | 11/1989 |
| DE | G 90 01 265 | | 5/1990 |
| DE | 3906219 | | 8/1990 |
| DE | 4302911 | | 8/1993 |
| DE | 4230535 | | 3/1994 |
| DE | 94 16 015.5 | U1 | 11/1994 |
| DE | 4321940 | | 1/1995 |
| DE | 69211891 | T2 | 10/1996 |
| DE | 19516485 | | 11/1996 |
| DE | 19727884 | | 2/1999 |
| DE | 69505433 | T2 | 4/1999 |
| DE | 19807973 | | 7/1999 |
| DE | 19824264 | | 12/1999 |
| DE | 19832990 | | 1/2000 |
| DE | 20000483 | | 8/2000 |
| DE | 10004105 | | 10/2000 |
| DE | 19958569 | | 2/2001 |
| DE | 199 41 362 | | 3/2001 |
| DE | 199 45 760 | | 3/2001 |
| DE | 19945760 | | 3/2001 |
| DE | 10103221 | A1 | 8/2001 |
| DE | 10031857 | | 1/2002 |
| DE | 10031858 | | 1/2002 |
| DE | 20114257 | | 2/2002 |
| DE | 10059406 | | 6/2002 |
| DE | 10135104 | | 9/2002 |

(56) References Cited

FOREIGN PATENT DOCUMENTS

| | | | |
|---|---|---|---|
| DE | 102 05 831 | | 8/2003 |
| DE | 10205831 | | 8/2003 |
| DE | 10311238 | | 10/2004 |
| DE | 10 2004 027 789 | | 2/2005 |
| DE | 29825120 | | 2/2005 |
| DE | 102004027789 | A1 | 2/2005 |
| DE | 69827994 | T2 | 4/2005 |
| DE | 20320781 | | 6/2005 |
| DE | 10 2004 014 646 | | 7/2005 |
| DE | 10 2004 003 438 | | 8/2005 |
| DE | 102004003439 | | 8/2005 |
| DE | 10 2004 007 733 | | 9/2005 |
| DE | 10 2004 021 298 | | 11/2005 |
| DE | 699 28 944 | T2 | 9/2006 |
| DE | 69535077 | T2 | 11/2006 |
| DE | 202007001031 | | 3/2007 |
| DE | 60200500 1173 | | 8/2007 |
| DE | 60206956 | T2 | 8/2008 |
| DE | 102007006547 | | 8/2008 |
| DE | 102007013628 | A1 | 9/2008 |
| DE | 102007039106 | | 2/2009 |
| DE | 102007052067 | | 5/2009 |
| DE | 20 2010 012 449 | U1 | 12/2010 |
| DE | 102009032399 | A1 | 1/2011 |
| DE | 102009053449 | | 2/2011 |
| DE | 102010060086 | | 4/2012 |
| DE | 102010056263 | A1 | 6/2012 |
| DE | 102011106060 | | 1/2013 |
| DE | 102011118120 | | 5/2013 |
| DE | 10 2011 120 717 | A1 | 6/2013 |
| DE | 112007001824 | B3 | 7/2013 |
| DE | 10 2012 013 464 | A1 | 11/2013 |
| DE | 10 2015 114202 | A1 | 1/2017 |
| EM | 002066910-0001 | | 3/2013 |
| EM | 002066910-0002 | | 3/2013 |
| EM | 002066910-0003 | | 3/2013 |
| EM | 002066910-0004 | | 3/2013 |
| EM | 002066910-0005 | | 3/2013 |
| EM | 002066910-0006 | | 3/2013 |
| EM | 002066910-0007 | | 3/2013 |
| EM | 002066910-0008 | | 3/2013 |
| EM | 002066910-0009 | | 3/2013 |
| EM | 002066910-0010 | | 3/2013 |
| EP | 0092043 | A2 | 10/1983 |
| EP | 0092392 | | 10/1983 |
| EP | 0114064 | A2 | 7/1984 |
| EP | 0313958 | A2 | 5/1989 |
| EP | 524408 | | 1/1993 |
| EP | 567325 | | 10/1993 |
| EP | 0631821 | | 1/1995 |
| EP | 0650766 | | 5/1995 |
| EP | 0650766 | A2 | 5/1995 |
| EP | 678334 | | 10/1995 |
| EP | 0706832 | | 4/1996 |
| EP | 0706832 | A1 | 4/1996 |
| EP | 0710506 | | 5/1996 |
| EP | 801002 | | 10/1997 |
| EP | 0846498 | A1 | 6/1998 |
| EP | 987060 | | 3/2000 |
| EP | 1081639 | | 3/2001 |
| EP | 1106262 | | 6/2001 |
| EP | 1 247 586 | | 10/2002 |
| EP | 1247586 | | 10/2002 |
| EP | 1277519 | | 1/2003 |
| EP | 1294490 | | 3/2003 |
| EP | 1299194 | | 4/2003 |
| EP | 1366823 | | 12/2003 |
| EP | 1412669 | | 4/2004 |
| EP | 1424135 | | 6/2004 |
| EP | 1477232 | A1 | 11/2004 |
| EP | 1479447 | A1 | 11/2004 |
| EP | 1504823 | A1 | 2/2005 |
| EP | 1563913 | | 8/2005 |
| EP | 1574262 | | 9/2005 |
| EP | 1602412 | | 12/2005 |
| EP | 1658902 | A1 | 5/2006 |
| EP | 1708822 | | 10/2006 |
| EP | 1708823 | | 10/2006 |
| EP | 1718415 | | 11/2006 |
| EP | 1880771 | A1 | 1/2008 |
| EP | 1902766 | A1 | 3/2008 |
| EP | 1902786 | | 3/2008 |
| EP | 1902876 | | 3/2008 |
| EP | 1930084 | | 6/2008 |
| EP | 1964616 | | 9/2008 |
| EP | 1964616 | A2 | 9/2008 |
| EP | 1997561 | A2 | 12/2008 |
| EP | 2017010 | A2 | 1/2009 |
| EP | 2027931 | | 2/2009 |
| EP | 2092987 | A1 | 8/2009 |
| EP | 2106298 | | 10/2009 |
| EP | 2111920 | | 10/2009 |
| EP | 2451586 | A1 | 5/2012 |
| EP | 2490819 | | 8/2012 |
| EP | 2576079 | | 4/2013 |
| EP | 2608890 | | 7/2013 |
| EP | 2 669 213 | A1 | 12/2013 |
| EP | 2703089 | A1 | 3/2014 |
| EP | 2 828 000 | A1 | 1/2015 |
| FR | 398333 | | 6/1909 |
| FR | 789762 | | 11/1935 |
| FR | 1410519 | | 9/1964 |
| FR | 2444501 | | 7/1980 |
| FR | 2462200 | A1 | 2/1981 |
| FR | 2 570 140 | | 3/1986 |
| FR | 2 774 928 | | 8/1999 |
| FR | 2863512 | A1 | 6/2005 |
| FR | 2927824 | A1 | 8/2009 |
| GB | 190900523 | | 6/1909 |
| GB | 657854 | A | 9/1951 |
| GB | 2 132 916 | | 7/1984 |
| GB | 2153260 | | 8/1985 |
| GB | 2372465 | | 8/2002 |
| GB | 2411235 | | 8/2005 |
| HK | 1100405 | | 6/2009 |
| HK | 1096057 | | 7/2009 |
| HK | 1125067 | | 8/2012 |
| HK | 1138533 | | 11/2012 |
| JP | S49-136868 | U | 11/1974 |
| JP | S55-107258 | U | 7/1980 |
| JP | S5654328 | | 5/1981 |
| JP | S57-75246 | | 5/1982 |
| JP | S57128346 | A | 8/1982 |
| JP | S5998757 | | 6/1984 |
| JP | S601722 | | 1/1985 |
| JP | S62160156 | A | 7/1987 |
| JP | H01-87805 | | 6/1989 |
| JP | H02258076 | A | 10/1990 |
| JP | H04-176352 | A | 6/1992 |
| JP | H0530749 | | 4/1993 |
| JP | H05172678 | | 7/1993 |
| JP | 674850 | | 3/1994 |
| JP | H06215741 | | 8/1994 |
| JP | H07204542 | A | 8/1995 |
| JP | H08196950 | | 8/1996 |
| JP | H08196950 | A | 8/1996 |
| JP | H09117697 | | 5/1997 |
| JP | 11-047643 | A | 2/1999 |
| JP | 2001259487 | | 9/2001 |
| JP | 2003042882 | | 2/2002 |
| JP | 2003088780 | | 3/2003 |
| JP | 2004-501763 | A | 1/2004 |
| JP | 2004017044 | | 1/2004 |
| JP | 2005138885 | | 6/2005 |
| JP | 2007516831 | | 6/2007 |
| JP | 2008018296 | A | 1/2008 |
| JP | 2010-528837 | A | 8/2010 |
| JP | 2014124274 | A | 7/2014 |
| KR | 20140064644 | A | 5/2014 |
| RU | 2523816 | C1 | 1/2014 |
| TW | 491092 | | 6/2002 |
| TW | 510253 | U | 11/2002 |
| TW | I220392 | | 8/2004 |
| TW | I303587 | | 12/2008 |

(56) References Cited

FOREIGN PATENT DOCUMENTS

| | | | |
|---|---|---|---|
| TW | I309584 | | 5/2009 |
| WO | 90/008456 | | 8/1990 |
| WO | 91/16610 | | 10/1991 |
| WO | 1992/07346 | | 4/1992 |
| WO | 9522409 | | 8/1995 |
| WO | 1998/32539 | | 7/1998 |
| WO | 01/012337 | | 2/2001 |
| WO | 2001/12337 | | 2/2001 |
| WO | 0166261 | | 9/2001 |
| WO | 01/099062 | | 12/2001 |
| WO | 02/000355 | | 1/2002 |
| WO | 0202242 | | 1/2002 |
| WO | 02/018061 | | 3/2002 |
| WO | 02/085533 | | 10/2002 |
| WO | 03/007252 | | 1/2003 |
| WO | 03/045575 | | 6/2003 |
| WO | 03/069208 | | 8/2003 |
| WO | 03069208 | A1 | 8/2003 |
| WO | 04/037433 | | 5/2004 |
| WO | 2004/37433 | | 5/2004 |
| WO | 04/052552 | | 6/2004 |
| WO | 05/018815 | | 3/2005 |
| WO | 05/068220 | | 7/2005 |
| WO | 05/070557 | | 8/2005 |
| WO | 05/070558 | | 8/2005 |
| WO | 05/077543 | | 8/2005 |
| WO | 05/115631 | | 12/2005 |
| WO | 2006065850 | | 6/2006 |
| WO | 07/128127 | | 11/2007 |
| WO | 2007133386 | A2 | 11/2007 |
| WO | 2007/149760 | A2 | 12/2007 |
| WO | 2009015260 | | 1/2009 |
| WO | 2009015260 | A2 | 1/2009 |
| WO | 2009/054986 | A1 | 4/2009 |
| WO | 2009056424 | | 5/2009 |
| WO | 2010019274 | A1 | 2/2010 |
| WO | 2010/044864 | A1 | 4/2010 |
| WO | 2011047876 | | 4/2011 |
| WO | 2011147555 | | 12/2011 |
| WO | 2012119664 | | 9/2012 |
| WO | 2013000524 | | 1/2013 |
| WO | 2013016474 | | 1/2013 |
| WO | 2013/131626 | A1 | 9/2013 |
| WO | 2013/142045 | A1 | 9/2013 |

OTHER PUBLICATIONS

Notice of Allowance dated Apr. 10, 2017 for U.S. Appl. No. 29/579,824.
Response to Final Office Action filed May 9, 2017 in U.S. Appl. No. 13/698,417.
Response to Office Action filed May 17, 2017 in U.S. Appl. No. 14/113,649.
Response to Election of Species Requirement and Amendment filed Oct. 15, 2018 from U.S. Appl. No. 15/679,482.
Chinese Search Report dated Jul. 18, 2018 for Application No. 2014103745834 filed Jul. 31, 2014.
DesignView of CN302452159 registered Jun. 5, 2013, printed Oct. 18, 2018.
Notice of Allowance dated Jan. 27, 2016 for Design U.S. Appl. No. 29/510,723.
Office Action dated Feb. 19, 2016 for U.S. Appl. No. 14/113,649.
Final Office Action dated Feb. 25, 2016 for U.S. Appl. No. 13/698,417.
Restriction Requirement dated Mar. 25, 2016 for Design U.S. Appl. No. 29/516,082.
Response filed Mar. 31, 2016 to Office Action dated Dec. 31, 2016 for U.S. Appl. No. 14/572,998.
Printout from Internet www.ehow.com explaining how to choose a spray gun and stating in item 2 "Nozzle sizes vary between about 1 mm and 2 mm.", printed Sep. 7, 2012 (Exhibit 1023 in IPR 2013-0111).
Printout from Internet www.bodyshopbusiness.com explaining how to choose nozzle setup in paragraph bridging pp. 1 and 2, giving general rule of thumb of nozzle sizes from 1.3 mm to 2.2 mm, depending on material being sprayed, printed Sep. 7, 2012 (Exhibit 1024 in IPR 2013-0111).
Printout from Internet of pages from brochure of Walther Pilot showing nozzle sizes for spray guns ranging from 0.3 mm to 2.5 mm, dated 2007, (Exhibit 1025 in IPR 2013-0111).
Printout from Internet www.alsacorp.com showing in the paragraph bridging pp. 2 and 3, Model VS-7200 Saber LVLP spray gun with nozzle size 1.3 mm with sizes 1.3 to 2.0 available, printed Aug. 26, 2012 (Exhibit 1026 in IPR 2013-0111).
Printout from Internet of p. 28 from current 3Mtm brochure showing Tip/Nozzle/Air Cap Selection Guide with nozzle sizes from 0.5 mm to 3.0 mm., (Exhibit 1027 in IPR 2013-0111).
Decision by EPO regarding opposition proceedings to revoke patent No. 99926841.0-2425/1108476, corresponding to '387 patent, 2012, (Exhibit 1029 in IPR 2013-0111).
SATA News Publication Dan-Am Jul.-Sep. 1996, (Exhibit 1034 in IPR 2013-0111).
SATA News Publication Dan-Am Oct.-Dec. 1996, (Exhibit 1035 in IPR 2013-0111).
SATA News Publication Dan-Am Apr.-Jun. 1998 (Exhibit 1036 in IPR 2013-0111).
Dan-Am SATA Catalog 6 for spray guns 1991 (Exhibit 1037 in IPR 2013-0111).
Dan-Am SATA Catalog 8 for spray guns 1994 (Exhibit 1038 in IPR 2013-0111).
Dan-Am Catalog 6-51pp published 1991, (Exhibit 1042 in IPR 2013-0111).
Japanese Industrial Standards B 9809 English translation, 1992 (Exhibit 1049 in IPR 2013-0111).
Japanese Industrial Standards B 9809 revised Mar. 1, 1991 (Exhibit 1050 in IPR 2013-0111).
SATA News, vol. 21, 2009 (Exhibit 2010 in IPR 2013-0111).
Collision Hub TV Document (image from video clip) printed Oct. 9, 2013 (Exhibit 2011 in IPR 2013-0111).
MyRielsMe.com document from press release printed Oct. 9, 2013 (Exhibit 2012 in IPR 2013-0111).
How to set Air pressure, Utube screenshot printed Oct. 9, 2013 (Exhibit 2013 in IPR 2013-0111).
Ohio EPA Letty to Tony Larimer, response to letter dated Aug. 2006 (Exhibit 2014 in IPR 2013-0111).
Pinahs Ben-Tzvi et al, A conceptual design . . . , Mechatrronics 17 (2007) p. 1-13 (Exhibit 2015 in IPR 2013-0111).
On line ad from Amazon.com printed Oct. 14, 2013 (Exhibit 2017 in IPR 2013-0111).
Rone et al, MEMS-Baed Microdroplet Generation with Integrated Sensing, COMSOL, 2011 (Exhibit 2018 in IPR 2013-0111).
International Search Report, Written Opinion and International Preliminary Report on Patentability for PCT/EP2004/005381 file May 19, 2004.
International Search Report, Written Opinion and International Preliminary Report on Patentability for PCT/EP2004/011998 filed Oct. 23, 2004.
International Search Report, Written Opinion and International Preliminary Report on Patentability for PCT/EP2005/000435 filed Jan. 18, 2005.
International Search Report, Written Opinion and International Preliminary Report on Patentability for PCT/EP2005/00437 filed Jan. 18, 2005.
International Search Report, Written Opinion and International Preliminary Report on Patentability for PCT/EP2008/063344, filed Oct. 6, 2008.
International Search Report, Written Opinion and International Preliminary Report on Patentability for PCT/EP2010/002392 filed Apr. 20, 2010.
International Search Report, Written Opinion and International Preliminary Report on Patentability for PCT/EP2011/002544 filed May 21, 2011.
International Search Report, Written Opinion and International Preliminary Report on Patentability for PCT/EP2011/066665 filed Sep. 26, 2011.

(56) References Cited

OTHER PUBLICATIONS

International Search Report, Written Opinion and International Preliminary Report on Patentability for PCT/EP2010/003399 filed Jun. 7, 2010.
International Search Report, Written Opinion and International Preliminary Report on Patentability for PCT/EP2011/5842 filed Dec. 2, 2010.
International Search Report, Written Opinion and International Preliminary Report on Patentability for PCT/EP2012/01939 filed May 5, 2012.
International Search Report, Written Opinion and International Preliminary Report on Patentability for PCT/EP2009/06992 filed Sep. 29, 2009.
Internet Archive Wayback Machine [online] [captured Sep. 25, 2012] [retrieved on Sep. 8, 2014] retrieved from the Internet URL:http://web.archive.org/web/20120925210554/http://www.sata.com/index.php?id=sal-check&no cache=1&L=11.
JP Office Action issued against JP Patent App. 2012-508926 dated Feb. 25, 2014 with English translation.
Response to Restriction Requirement filed in U.S. Appl. No. 14/815,210 dated Jun. 19, 2017.
International Preliminary Report on Patentability for PCT/EP2015/001728 filed Aug. 25, 2015.
Final Office Action dated Mar. 16, 2017 from U.S. Appl. No. 13/698,417, 9 pages.
International Search Report dated Jul. 14, 2016 for International Application No. PCT/EP2016/000809, filed May 17, 2016.
Written Opinion for International Application No. PCT/EP2016/000809, filed May 17, 2016.
Response filed Dec. 21, 2015 to Office Action dated Jul. 20, 2015 for U.S. Appl. No. 14/113,649.
International Search Report dated Aug. 31, 2016 for PCT/EP2016/061057 filed May 18, 2016.
Written Opinion for PCT/EP2016/061057 filed May 18, 2016.
Response restriction requirement filed May 23, 2016 for Design U.S. Appl. No. 29/516,082.
Canadian Office Action dated Nov. 21, 2012 for related application CA2741703.
Chinese Search Report dated Dec. 5, 2012 for related application CN200980135429.9.
Chinese Office Action dated Dec. 13, 2012 for related application CN200980135429.9.
German Search Report for DE 20 2008 014 389.6 completed Jul. 13, 2009.
Response to Final Office Action and RCE dated Nov. 29, 2016 in U.S. Appl. No. 14/113,649.
Response to Office Action filed Feb. 16, 2016 for U.S. Appl. No. 13/698,417.
Screen shot of a SATA product (SATAjet B) description retrieved on Feb. 12, 2016 from www.sata.com/index.php.
"The Hot Rolling Process;" California Steel; retrieved on Feb. 12, 2016 from http://www.californiasteel.com/GetPublicFile.aspx?id=53.
Final Office Action in U.S. Appl. No. 14/113,649 dated Jun. 22, 2017.
Response filed in U.S. Appl. No. 15/143,698 dated Jul. 3, 2017.
U.S. Appl. No. 14/815,210 Office Action dated Apr. 3, 2018.
U.S. Appl. No. 14/113,649 Response filed Mar. 3, 2018.
German Search Report dated Apr. 10, 2018 for Application No. 10 2017 118 599.2.
International Search Report (dated Jun. 20, 2008), Written Opinion (dated Jun. 20, 2008), and International Preliminary Report on Patentability (dated Sep. 14, 2010) from PCT/US2008/03318 filed Mar. 12, 2008.
Response filed Dec. 7, 2015 to Office Action dated Aug. 7, 2015 for U.S. Appl. No. 13/991,285.
Office Action dated Nov. 18, 2014 for U.S. Appl. No. 14/113,649.
Notice of Allowance dated Nov. 19, 2014 for U.S. Appl. No. 29/486,223.
Office Action dated Dec. 31, 2014 for U.S. Appl. No. 13/380,949.
Restriction Requirement dated Jan. 9, 2015 for Design U.S. Appl. No. 29/469,049.
Response to Office Action filed Dec. 2, 2014 for U.S. Appl. No. 29/487,679.
Notice of Allowance dated Jan. 15, 2015 for Design U.S. Appl. No. 29/490,620.
Office Action dated Jan. 14, 2015 for Design U.S. Appl. No. 29/447,887.
Hercules Paint Gun Washers brochure publish date Jan. 2012, [online], [site visited Jan. 7, 2015], <http://www.herkules.us/pdfs/L00761-Hercules-Gun_Washers-4-page-brochure.pdf>.
Jetclean GUn Cleaner Terry's Auto Supply, google publish date Aug. 4, 2011, [online], [site visited Jan. 7, 2015], <http://secure.terrys.net/viewProduct.php?productID=FT.FHAZ1005>.
Restriction Requirement dated Feb. 6, 2015 for Design U.S. Appl. No. 29/486,232.
Office Action dated Mar. 30, 2015 for U.S. Appl. No. 13/698,417.
Responde to Office Action filed Apr. 14, 2015 to Office Action dated Jan. 14, 2015 for U.S. Appl. No. 29/447,887.
Response filed Jul. 20, 2015 for Office Action dated Mar. 30, 2015 for U.S. Appl. No. 13/698,417.
Notice of Allowance dated Apr. 30, 2015 for U.S. Appl. No. 29/447,887.
Chinese Office Action dated Oct. 28, 2014 and Search Report dared Oct. 15, 2014 for Chinese Application No. 2011800266029.
Australian Examination Report dated Oct. 30, 2012 for Australian Application No. 2010268870.
Notice of Allowance dated Apr. 24, 2015 for Design U.S. Appl. No. 29/486,232.
Restriction Requirement dated Jan. 22, 2015 for U.S. Appl. No. 13/698,417.
Response filed Mar. 23, 2015 to Restriction Requirement dated Jan. 22, 2015 for U.S. Appl. No. 13/698,417.
Response filed Apr. 6, 2015 to Office Action dated Feb. 6, 2015 for Design U.S. Appl. No. 29/486,232.
Response filed Mar. 31, 2015 to Office Action dated Dec. 31, 2014 for U.S. Appl. No. 13/380,949.
Japanese Office Action dated Jun. 11, 2014 for Japanese Patent Application No. 2012-518769.
Australian Examination Report dated Nov. 11, 2014 for Australian patent Application No. 2011257605.
Japanese Notice of Allowance dated Jan. 13, 2015 for Japanese Patent Application No. 2012/518769.
Application filed Dec. 11, 2011 for U.S. Appl. No. 13/380,949.
Chinese Office Action dated Jan. 28, 2014 and Search Report dated Jan. 21, 2014 for Chinese Application No. 201080030935.4.
Search Report dated Apr. 24, 2010 for German Application No. 10 2009 032 399.6-51.
Application filed Oct. 24, 2013 for U.S. Appl. No. 14/113,649.
Response filed May 18, 2015 to Office Action dated Nov. 18, 2014 for U.S. Appl. No. 14/113,649.
Application filed Dec. 17, 2014 for U.S. Appl. No. 14/572,998.
German Search Report dated Mar. 25, 2014 for German Application No. 202013105779-7.
Application filed Nov. 16, 2012 for U.S. Appl. No. 13/698,417.
Application filed Jun. 2, 2013 for U.S. Appl. No. 13/991,285.
English translation of application filed Aug. 13, 2013 for Application filed Jun. 2, 2013 for U.S. Appl. No. 13/991,285.
Restriction Requirement dated May 27, 2015 for U.S. Appl. No. 13/991,285.
Application filed Jan. 29, 2015 for Design U.S. Appl. No. 29/516,073.
Application filed Jan. 29, 2015 for Design U.S. Appl. No. 29/516,082.
Application filed Mar. 3, 2015, 2015 for Design U.S. Appl. No. 29/519,198.
Final Office Action dated Jul. 20, 2015 for U.S. Appl. No. 14/113,649.
Notification of the First Office Action with search report dated Aug. 24, 2015 for Chinese Application No. 201280020519.5 (related to U.S. Appl. No. 14/113,649), 13 pages.
Notification of the Second Office Action dated May 16, 2016, for Chinese Application No. 201280020519.5 (related to U.S. Appl. No. 14/113,649), 5 pages.
Japanese Office Action for JP2014-517485 (related to U.S. Appl. No. 14/113,649), dated Jul. 5, 2016, 16 pages.

(56) References Cited

OTHER PUBLICATIONS

German Search Report for Application No. 10 2016 009 957.7 dated Apr. 21, 2017.
European Search Report dated May 8, 2017 for Application No. EP16203544.
"Spray Guns/sata.com", Oct. 18, 2015, XP055364928 URL:http://web.archive.org/web/20151018205307/http://www.sata.com/index.php?id=lackierpistolen&L=11 [gefunden am Apr. 13, 2017]; reprinted on Dec. 8, 2017.
"SATAjet 5000 B Lackierpistolen | Bechersysteme | Atemschutz | Filtertechnik | Zubehor So flexibel wie Ihre Aufgaben" Apr. 11, 2017, XP055364477 Gefunden im Internet: URL:https/www.sata.com/uploads/tx_pxspecialcontent/00_SATAjet_5000_B.pdf [gefunden am Apr. 12, 2017]; English translation of full brochure attached.
Amendments submitted to European Patent Office dated Dec. 3, 2017 for Application No. EP16203544 (with English translation of chart on p. 3).
German Search Report dated Apr. 21, 2017 for application No. 10 2016 009 957.7.
Written Opinion dated Sep. 8, 2016 for International Application No. PCT/EP2016/061057 filed May 18, 2016.
Office Action from U.S. Appl. No. 15/143,698 dated Jan. 5, 2017.
German Search Report for German Application No. 10 2015 016 474.0 dated Aug. 9, 2016, 14 pages.
Notice of Allowance in U.S. Appl. No. 29/556,463, filed Mar. 1, 2016, 9 pages.
Notice of Allowance in U.S. Appl. No. 29/555,656, filed Feb. 24, 2016, 5 pages.
Notice of Allowance dated Apr. 18, 2016 for U.S. Appl. No. 14/572,998.
Response filed Apr. 27, 2016 to Office Action dated Jan. 29, 2016 for U.S. Appl. No. 13/380,949.
German Search Report dated Apr. 12, 2016 for related German Application No. 10 2015 008 735.5.
Final Office Action dated Dec. 7, 2017 for U.S. Appl. No. 14/815,210.
Response to Office Action dated Jun. 25, 2018 for U.S. Appl. No. 14/815,210.
Response to Final Office Action dated Aug. 22, 2018 for U.S. Appl. No. 14/113,649.
Office Action dated Jun. 30, 2017 for U.S. Appl. No. 14/815,210.
Second Chinese Office Action dated Jun. 24, 2015 for Chinese Application No. 2011800266029.
Third Chinese Office Action dated Nov. 30, 2015 for Chinese Application No. 2011800266029.
Final Office Action dated Aug. 29, 2016 for U.S. Appl. No. 14/113,649.
Office Action dated Nov. 2, 2016 for U.S. Appl. No. 11/949,122.
May 22, 2018 Final Office Action for U.S. Appl. No. 14/113,649.
Office Action dated Dec. 31, 2015 for U.S. Appl. No. 14/572,998.
Notice of Allowance dated Jan. 19, 2016 for Design U.S. Appl. No. 29/539,615.
Notice of Allowance dated Jan. 22, 2016 for U.S. Appl. No. 13/991,285.
Restriction Requirement Office Action dated Aug. 28, 2018 in U.S. Appl. No. 15/679,533.
Notice of Allowance dated Sep. 14, 2018 in U.S. Appl. No. 29/618,945.
Notice of Allowance dated Sep. 14, 2018 in U.S. Appl. No. 14/113,649.
Final Office Action dated Sep. 12, 2018 in U.S. Appl. No. 14/815,210.
European Search Report dated Jan. 24, 2018 for Application No. 17186905.
Office Action dated Jan. 25, 2019 for U.S. Appl. No. 15/379,972.
Restriction Requirement dated Mar. 18, 2019, for U.S. Appl. No. 29/596,869.
Office Action dated Mar. 15, 2019, for U.S. Appl. No. 14/815,210.
Office Action, dated Jan. 15, 2019, for U.S. Appl. No. 15/679,533.
Reply to Office Action filed Oct. 11, 2019 for U.S. Appl. No. 15/679,461.
Search Report dated Feb. 22, 2019 for German Patent Application No. 10 2018 118 738.6.
Search Report dated Feb. 8, 2019 for German Patent Application No. 10 2018 118 737.8.
Notice of Allowance dated Jul. 1, 2019 for U.S. Appl. No. 15/379,972.
Notice of Allowance dated Jul. 9, 2019 for U.S. Appl. No. 15/679,482.
European Search Report, dated Jan. 20, 2020, for European Application No. 19183380.
Final Office Action dated Aug. 12, 2019 from U.S. Appl. No. 14/815,210.
Response filed May 28, 2019 for U.S. Appl. No. 15,379,972.
Final Office Action for U.S. Appl. No. 15/679,461 dated Jun. 11, 2019.
Final Office Action for U.S. Appl. No. 15/679,533 dated Jul. 12, 2019.
Japanese Office Action dated Sep. 25, 2019, for Japanese Publication No. 2015-149405, 4 pages.
Response to Final Office Action, dated Nov. 11, 2019, for U.S. Appl. No. 14/815,210, 20 pages.
Office Action, dated Nov. 20, 2019, for U.S. Appl. No. 15/575,549, 12 pages.
Office Action, dated Dec. 9, 2019, for U.S. Appl. No. 14/815,210, 6 pages.
Response to Restriction Requirement, filed Oct. 29, 2019, for U.S. Appl. No. 15/575,549.
Response to Office Action dated Apr. 9, 2019 for U.S. Appl. No. 15/679,533 (22 pages).
European Search Report dated Feb. 21, 2020 for Application No. 19183382.1.
Response dated Feb. 19, 2020 for U.S. Appl. No. 15/575,549.
Final Office Action dated Feb. 27, 2020 for U.S. Appl. No. 15/575,549.
German Search Report dated Mar. 18, 2016 for Application No. 20 2015 003 664.3, 5 pages.
Chinese Search Report dated Feb. 21, 2019 for Application No. 2016800293781, 3 pages.
Response to Office Action dated Mar. 9, 2020 for U.S. Appl. No. 14/815,210.
Notice of Allowance for U.S. Appl. No. 14/815,210 dated Mar. 25, 2020.
Office Action, dated Jan. 9, 2019, for U.S. Appl. No. 15/679,482.

* cited by examiner

TRIGGER FOR A SPRAY GUN AND SPRAY GUN HAVING SAME

FIELD OF THE DISCLOSURE

The disclosure relates to the field of spraying, and more particularly to a spray gun and a trigger for the same.

BACKGROUND

The spray gun is a tool commonly used in industry, for instance, it may be used to spray paint to surfaces of various articles such as furniture, machines and particularly vehicles (corresponding automobile bodies). The spray gun can comprise a material container for receiving a paint material and a spray gun body for spraying the paint material.

FIG. 1 shows a sectional view of a spray gun in the prior art. A spray gun 1 comprises a handle 21, a spray gun body 2 and a spray head 23 located in front of the spray gun body 2. The spray gun is supplied with compressed air via an air connection 3. The spray gun 1 has a cup connector 4, to which a cup can be connected. The cup contains a paint that is to be sprayed with the spray gun. The paint flows from the cup through a paint inlet 41 into a paint channel 42. A paint nozzle 6 is sealed by a paint needle 10, whereby the paint cannot leave the spray gun. When a trigger 11 is actuated, an air piston head 12, which seals an air supply 9 against air channels inside the spray gun body, is moved backwards and away from its seat. By that, the compressed air can flow through the inner air channels to flow to an air nozzle 5. The air nozzle 5 is a circular orifice provided to surround the paint nozzle 6. The compressed air is blown out of the air nozzle under pressure.

When the trigger 11 is pressed in excess of a certain point, the paint needle 10 is moved backwards, leaves the seat in the paint nozzle 6, then the paint nozzle 6 is opened. The paint in the paint channel 42 can flow out of the paint nozzle 6. The compressed air that is blown out of the air nozzle 5 generates a vacuum that sucks the paint out of the paint nozzle 6. Additionally, the paint is pressed out of the nozzle by the following paint.

FIG. 2 shows the trigger 11, which has two arms 11*a* and 11*b*, which clasp around the spray gun body when the trigger 11 is mounted. Each arm 11*a*, 11*b* has an upper hole and a lower hole. The upper holes are aligned to a borehole 13 in the gun body 2, before a trigger bolt 15 is inserted through the upper holes of the trigger arms 11*a*, 11*b* and the borehole 13. The trigger bolt 15 is preferably a hollow or not hollow cylindrical part. To avoid that the trigger bolt 15 is inserted into the spray gun body 2 to far, the trigger bolt 15 has a collar on one end, whose outer diameter is bigger than the inner diameters of the borehole 13 and the upper holes in the trigger arm 11*b*. The trigger bolt 15 is secured by a retainer clip 15*a*, which can be clipped into a groove in the other end of the trigger bolt 15. Preferably, the groove is circular around the trigger bolt 15. The trigger 11 is then rotatable around an axis of the borehole 13. After or before the trigger bolt 15 is or was arranged at the spray gun body 2, a trigger roller 16 is arranged. For that purpose, the lower holes of the trigger arms 11*a*, 11*b* are aligned to a window 14 in the upper spray gun body 2. The trigger roller 16 is inserted through the lower holes of the trigger arms 11*a*, 11*b* and the window 14. Like the trigger bolt 15, the trigger roller 16 can have a collar on one side and a groove on its other side. The trigger roller 16 can be secured by the retainer clip 16*a*. The trigger roller 16 can also be secured by the retainer clips 16*a* on both sides, if no collar is arranged at the trigger roller.

The trigger 11 still can rotate around the axis of borehole 13. When the trigger 11 is actuated, the trigger roller 16 is moved into the window 14. As shown in FIG. 2, the trigger roller 16 is provided with a borehole 16*b*. Through this borehole 16*b*, the paint needle 10, which is shown in FIG. 1, is arranged. As shown in FIG. 1, the paint needle 10 has a puller 17, which is permanently fixed to the paint needle 10.

When the trigger 11 is actuated, the trigger roller 16 is moved backward in a direction toward the puller 17. After some millimetres of movement, during which the air piston head 12 in FIG. 1 is moved out of its seat by what the air supply is activated, the trigger roller 16 touches the puller 17, and due to further backward movement of the trigger roller 16, it presses and pushes backwards the puller 17 and the paint needle connected therewith. By that, the air needle 10 steps out of a front orifice of the paint nozzle 6, and the paint can flow out of the paint nozzle 6.

The disadvantages of the prior art disclosed above include the following: It is necessary to remove the paint needle 10 and other parts out of the spray gun 1, e.g. when the spray gun 1 or parts thereof need to be cleaned or repaired. The spray gun 1 should be re-assembled after the cleaning or repair. When the paint needle 10 is arranged through the borehole in the trigger roller 16, the trigger roller 16 must have a certain orientation. This is because the axis of the borehole 16*b* may not have a too big angle to the axis of the paint needle 10. If the both axes coincide, it is easy to arrange the paint needle 10 in the borehole 16*b*, because the borehole 16*b* directs into the direction of the paint needle 10. However, if the trigger roller 16 is turned and the borehole 16*b* directs up- or downwards, it is not possible to arrange the paint needle 10 in the borehole 16*b*.

In the last case, the trigger roller 16 has to be partially pulled out of the trigger's holes, turned into the right position and then pushed into the trigger's holes without further turning the trigger roller 16.

This is time-consuming and can be frustrating for a user of the spray gun. Further, when the trigger roller 16 has a wrong orientation, it can happen that the user pushes the paint needle 10 against the outer surface of the trigger roller 16 or scratches it against an inner wall of the borehole 16*b*, by what the paint needle 10 can easily be damaged. As the paint needle is a very exactly and precisely manufactured part and critical for the spray quality of the spray gun, small damages can have a very bad effect to the spraying result. Further, as the paint needle acts as a sealing of the paint nozzle when the spray gun is not operated, a damaged paint needle can be the reason for a bad sealing effect. In that case, the paint can drop out of the paint nozzle.

In view of this, a patent document (CN 203508251 C) proposes an anti-rotation mechanism provided on a spray gun and used for orienting and locking a trigger roller, so as to solve the above-mentioned problems that the trigger roller needs to be oriented and it is not easy to install the trigger roller.

However, in the above patent document (CN 203508251 C), in the process of assembling the trigger to the spray gun body, before the trigger bolt 15 is inserted through the upper holes of the trigger arms 11*a*, 11*b* and the borehole 13, the upper holes of the two trigger arms 11*a*, 11*b* should be aligned to the borehole 13 in the spray gun body 2, and the lower holes of the trigger arms 11*a*, 11*b* should be aligned to the window 14 in the upper spray gun body 2, thus there is a problem that it is not easy for the user to detach and install the trigger.

SUMMARY

In order to address the above-identified issues, the disclosure relates to a spray gun and a trigger for the same, wherein the trigger can be more easily and reliably assembled onto a spray gun body and reduce the possibility of damaging parts of the spray gun.

A first aspect of the disclosure provides a one-armed trigger for a spray gun, comprising a single connecting arm, secured to a left side or a right side of a spray gun body of the spray gun; an operating portion, provided at a lower end of the connecting arm; and an actuating component, provided on the connecting arm.

By providing the connecting arm of the trigger as a single arm, the installation can be completed just by aligning an installation component (for example, installation sleeve) provided on the single arm to the single installation hole on the spray gun body, thus it is easier to carry out the operation compared with the prior art in which the orifices on two arms of the U-shaped arm should be aligned to the orifices at both sides of the spray gun body for assembling, moreover, one side (a left side or a right side) of the spray gun body can be manufactured into a bigger flat surface, so that a sign marking the spray gun can be arranged on this bigger surface, i.e. the spray gun is made more pleasing.

In one preferable embodiment according to the disclosure, the one-armed trigger further comprises: an installation sleeve, provided at an upper end of the connecting arm; and a fastening means, passing through the installation sleeve, used to pivotably secure the one-armed trigger onto the spray gun body.

In one preferable embodiment according to the disclosure, the fastening means is a fastening screw, the fastening screw comprising: a rod portion; a head portion located at one end of the rod portion and having a diameter bigger than the rod portion; and a threaded portion located at the other end of the rod portion and having a diameter smaller than the rod portion.

In one preferable embodiment according to the disclosure, the fastening means comprises: a first fastening element, having a circumferential collar and a threaded portion used to be fastened to the spray gun body; a second fastening element, the second fastening element being co-axially fixed and connected with the first fastening element; and the installation sleeve, sleeved outside the first fastening element and the second fastening element, and arranged between the head portion of the second fastening element and the circumferential collar with a clearance along an axial direction.

In one preferable embodiment according to the disclosure, the circumferential collar and the threaded portion of the first fastening element are located at a first end of the first fastening element, the first fastening element internally has a threaded hole opened towards a second end of the first fastening element; the second fastening element has a rod portion and a head portion, the rod portion of the second fastening element matches the threaded hole of the first fastening element, and the head portion of the second fastening element presses against the second end of the first fastening element.

In one preferable embodiment according to the disclosure, the fastening means further comprises a ring, the head portion of the second second fastening element presses against the second end of the first fastening element in a manner of the ring being sandwiched between the head portion of the second fastening element and the second end of the first fastening element.

In one preferable embodiment according to the disclosure, the installation sleeve has a first end provided on the connecting arm and a second end against which the circumferential collar abuts, and a distance from the second end of the first fastening element to the second end of the installation sleeve is bigger than a distance from the first end of the installation sleeve to the second end of the installation sleeve.

In one preferable embodiment according to the disclosure, the connecting arm is provided with a recess to receive a head portion of the second fastening element.

In one preferable embodiment according to the disclosure, the installation sleeve and the connecting arm are formed in one piece.

In one preferable embodiment according to the disclosure, the first fastening element, the second fastening element and the ring are fixed against each other, and the installation sleeve is rotatable with respect to these components as a whole.

In one preferable embodiment according to the disclosure, the actuating component comprises a first extension element and a second extension element extending from the connecting arm, and a gap is defined between the first extension element and the second extension element.

In one preferable embodiment according to the disclosure, the first extension element and the second extension element extending from the connecting arm in a manner of non-parallel to each other.

In one preferable embodiment according to the disclosure, a width of the first extension element is different from an extending width of the second extension element.

In one preferable embodiment according to the disclosure, an extension element of the first extension element and the second extension element close to the operating portion of the trigger has a smaller width.

In one preferable embodiment according to the disclosure, the connecting arm has a recess in a lateral surface.

A second aspect of the disclosure provides a spray gun, comprising a spray gun body, a paint needle, a puller secured to the paint needle and a trigger, the paint needle being movably arranged inside the spray gun body, and the trigger comprising an actuating component configured to be capable of pushing the puller so as to make the paint needle to be moved, characterized in that the trigger is a one-armed trigger, the trigger has a single connecting arm secured to a left side or a right side of the spray gun body, and the actuating component is provided on the connecting arm of the trigger.

In one preferable embodiment according to the disclosure, the trigger further comprises: an installation sleeve, provided at an upper end of the connecting arm; and a fastening means, passing through the installation sleeve, used to pivotably secure the one-armed trigger onto the spray gun body.

In one preferable embodiment according to the disclosure, the spray gun body is provided with an installation hole for the installation sleeve and the fastening means to be inserted thereinto so as to pivotably secure the one-armed trigger onto the spray gun body.

In one preferable embodiment according to the disclosure, the installation hole comprises a first section having a first diameter and a second section having a second diameter smaller than the first diameter.

In one preferable embodiment according to the disclosure, the fastening means is a fastening screw, the fastening screw comprising: a rod portion, received in the installation sleeve; a head portion located at one end of the rod portion and having a diameter bigger than the rod portion; and a threaded portion located at the other end of the rod portion and having a diameter smaller than the rod portion, the threaded portion being fastened into the second section of the installation hole.

In one preferable embodiment according to the disclosure, the fastening means comprises: a first fastening element, having a circumferential collar and a threaded portion used to be fastened into the second section of the installation hole; a second fastening element, the second fastening element being co-axially fixed and connected with the first fastening element; and the installation sleeve, sleeved outside the first fastening element and the second fastening element, and arranged between a head portion of the second fastening element and the circumferential collar with a clearance along an axial direction.

In one preferable embodiment according to the disclosure, the circumferential collar and the threaded portion of the first fastening element are located at a first end of the first fastening element, the first fastening element internally has a threaded hole opened towards a second end of the first fastening element; the second fastening element has a rod portion and a head portion, the rod portion of the second fastening element matches the threaded hole of the first fastening element, and the head portion of the second fastening element presses against the second end of the first fastening element.

In one preferable embodiment according to the disclosure, the fastening means further comprises a ring, the head portion of the second fastening element presses against the second end of the first fastening element in a manner of the ring being sandwiched between the head portion of the second fastening element and the second end of the first fastening element.

In one preferable embodiment according to the disclosure, the installation sleeve has a first end provided on the connecting arm and a second end against which the circumferential collar abuts, and a distance from the second end of the first fastening element to the second end of the installation sleeve is bigger than a distance from the first end of the installation sleeve to the second end of the installation sleeve.

In one preferable embodiment according to the disclosure, the connecting arm is provided with a recess so that the rod portion of the second fastening element passes through the recess to be thereby fastened into the threaded hole of the first fastening element, and the head portion of the second fastening element is arranged in the recess.

In one preferable embodiment according to the disclosure, the first fastening element, the second fastening element and the ring are fixed against each other, and the installation sleeve is rotatable with respect to these components as a whole.

In one preferable embodiment according to the disclosure, there is a gap between the first end of the installation sleeve provided on the connecting arm and an end of the ring abutting against the second end of the first fastening element.

In one preferable embodiment according to the disclosure, the installation sleeve and the connecting arm are formed in one piece.

In one preferable embodiment according to the disclosure, the actuating component comprises a first extension element and a second extension element extending from the connecting arm, and a gap is defined between the first extension element and the second extension element so as to make the paint needle pass therethrough.

In one preferable embodiment according to the disclosure, the gap defined between the first extension element and the second extension element is increased as far away from the puller.

In one preferable embodiment according to the disclosure, a width of the first extension element is different from an extending width of the second extension element.

In one preferable embodiment according to the disclosure, an extension element of the first extension element and the second extension element close to an operating portion of the trigger has a smaller width.

In one preferable embodiment according to the disclosure, the spray gun further comprises a protective element, and the protective element is sleeve-connected on the actuating component so as to push the puller.

In one preferable embodiment according to the disclosure, a left side or a right side of the spray gun body is provide with a window so as to expose the paint needle and the puller, and the connecting arm is assembled to the spray gun body in a manner of covering the window.

In one preferable embodiment according to the disclosure, the connecting arm has a recess in a lateral surface.

The trigger and the spray gun according to the disclosure provide convenience of disassembling between the trigger and the spray gun, and can make the appearance of the spray gun more pleasing, meanwhile also can avoid damage to parts such as the paint needle.

BRIEF DESCRIPTION OF THE DRAWINGS

The drawings constitute a portion of the description for further understanding of the disclosure. These drawings illustrate the embodiments of the disclosure and explain the principle of the disclosure together with the description. In the drawings, the same part is represented by the same reference sign. In the drawings.

DETAILED DESCRIPTION OF THE EMBODIMENTS

In the detailed description below, reference is made to the figures which constitute a portion of the present description, wherein embodiments which can implement the disclosure are illustratively shown. With regard to the figures, directional terms such as "top", "bottom", "inner", "outer" and so on are used with reference to directions in the described figures. Since components in the examples of the disclosure can be placed in many different directions, the directional terms are merely used for illustration without any restrictions. It should be understood that other examples can be used, and structural or logical changes can be made without departing from the scope of the disclosure. Therefore, the following detailed description should not be construed as limiting, and the disclosure is defined by the attached claims.

It should be understood that features in different exemplary examples described herein can be combined with each other unless otherwise specified.

Figure 1:
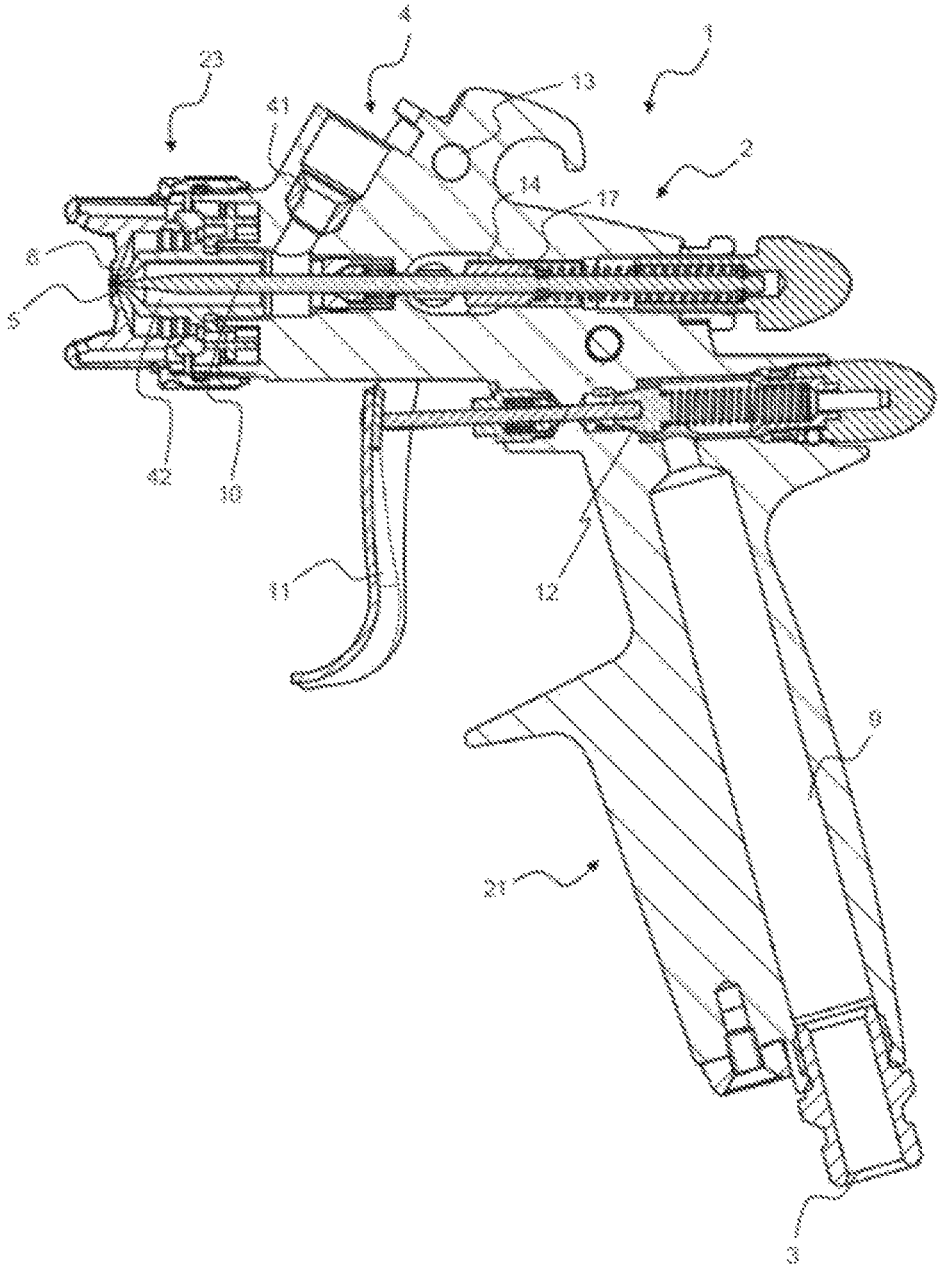
FIG. 1 (Prior Art)
FIG. 1 is a sectional view showing a spray gun in the prior art.
Figure 2:
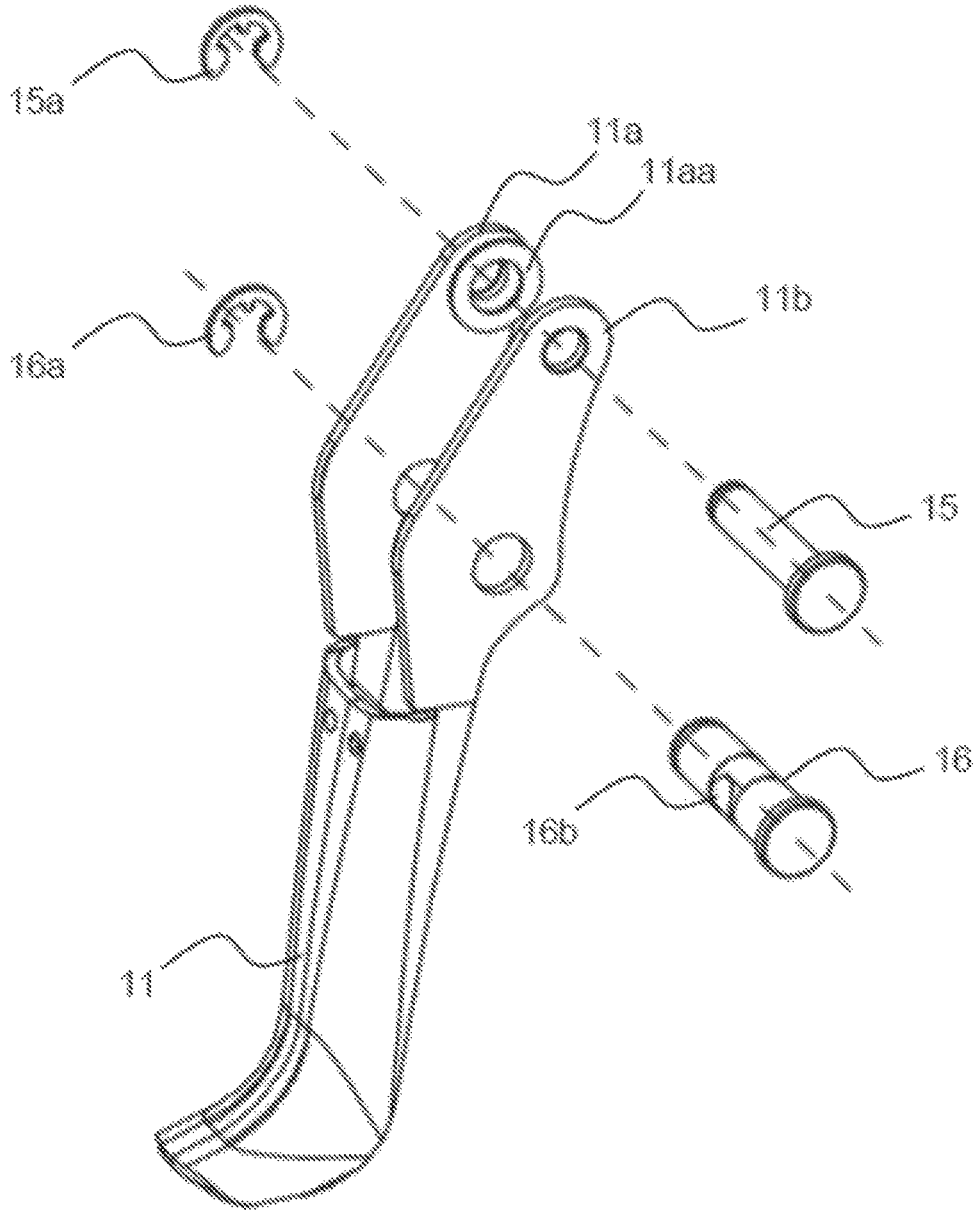
FIG. 2 (Prior Art)
FIG. 2 is a perspective diagram showing a trigger of the spray gun in the prior art.
Figure 3:
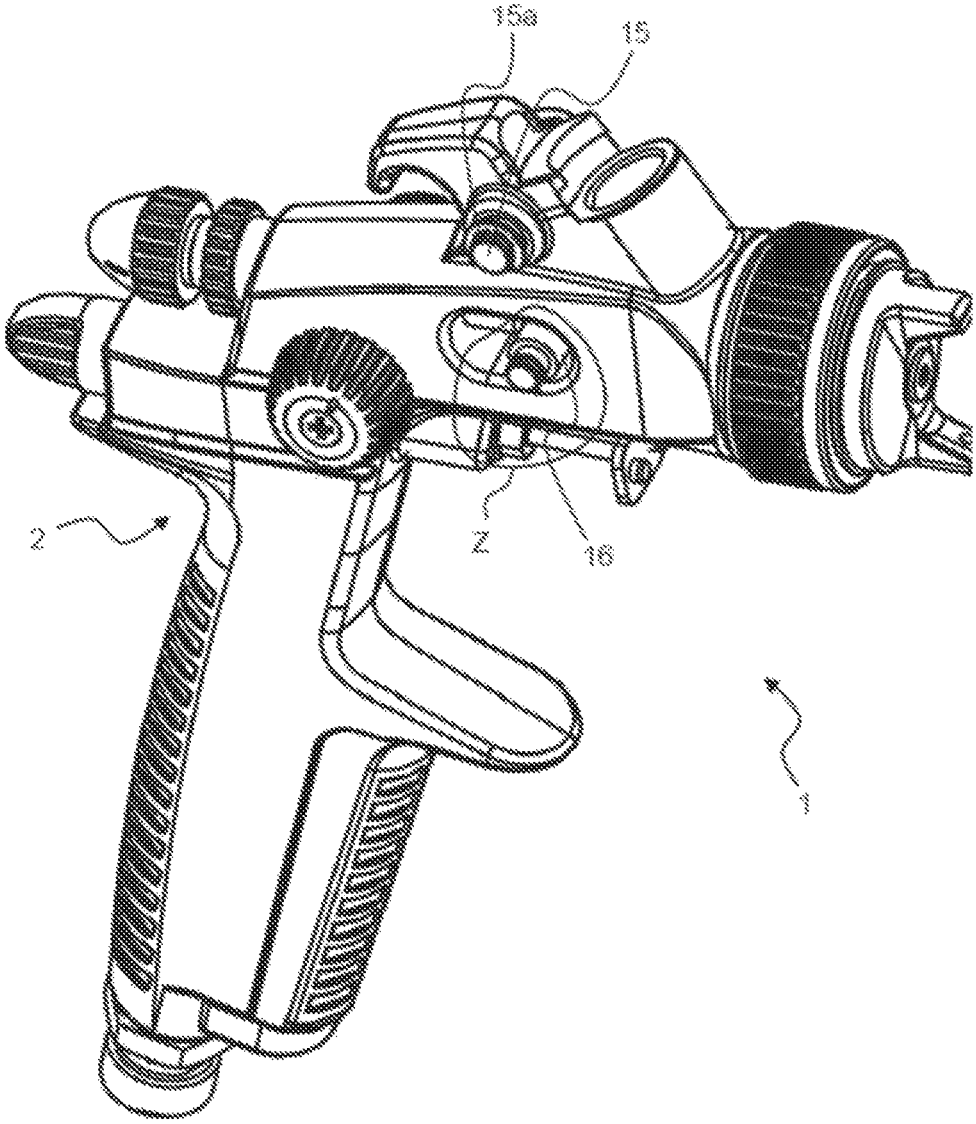
FIG. 3 (Prior Art)
FIG. 3 is a perspective diagram showing the spray gun in the prior art.
Figure 4A:
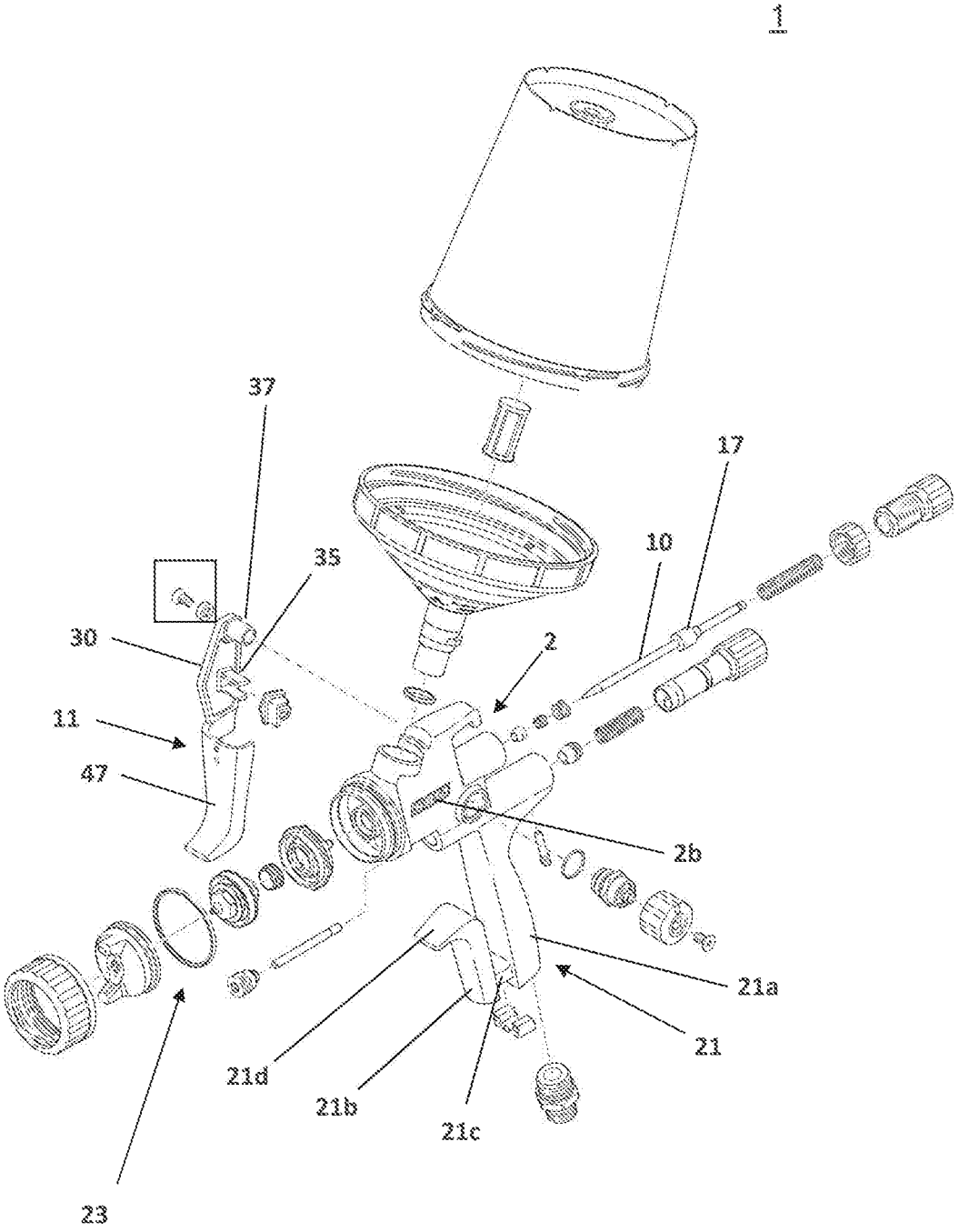
FIG. 4A and FIG. 4B are respectively exploded diagrams showing a spray gun according to the disclosure as seen from the opposite sides.
Figure 4B:
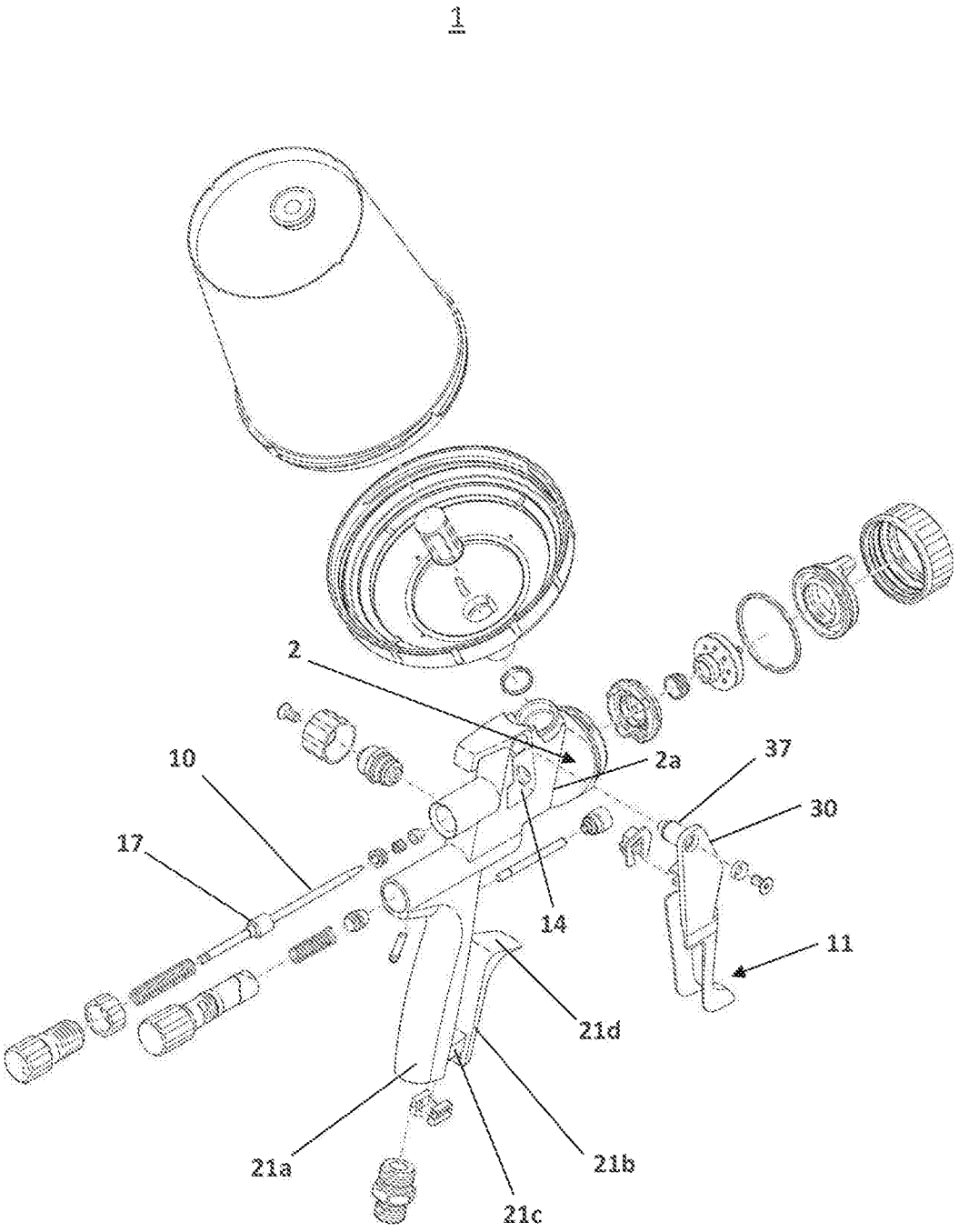

Reference will be made to FIGS. 4A and 4B to describe in detail the spray gun according to an example of the disclosure, wherein FIGS. 4A and 4B are perspective diagrams respectively showing the spray gun according to the example of the disclosure as viewed from the opposite sides of the spray gun.

Figure 5A:
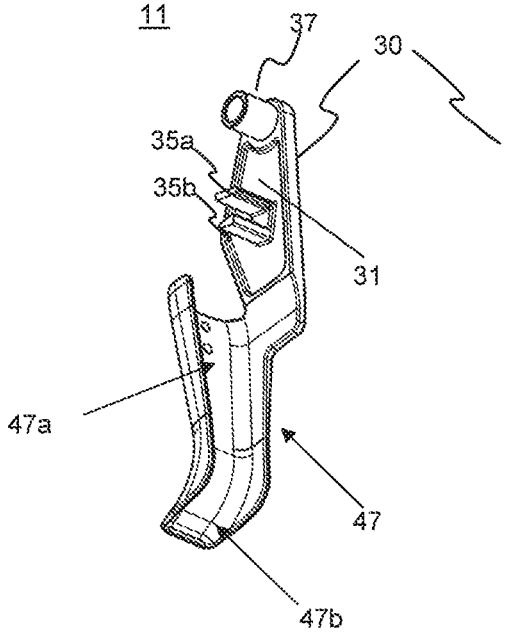
FIG. 5A and FIG. 5B respectively are exploded diagrams showing a perspective view and a front view of a trigger according to the disclosure.
Figure 5B:
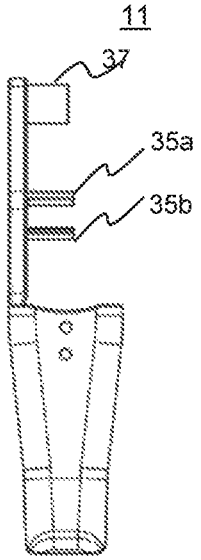

As shown in FIGS. 4A and 4B, a spray gun 1 according to the disclosure comprises a spray gun body 2, a spray head 23 engaged to the head of the spray gun body 2, a handle 21 engaged to a lower part of the spray gun body 2, a paint needle 10, a puller 17 secured to the paint needle 10 and a trigger 11, wherein the paint needle 10 is movably arranged inside the spray gun body 2. The trigger 11 comprises an actuating component 35 configured to be capable of pushing the puller 17 so as to make the paint needle 10 to be moved away from the spray head 23. Moreover, the trigger 11 is a one-armed trigger, that is, the trigger 11 comprises a single connecting arm 30 secured to a left side or a right side of the spray gun body 2 and an operating portion 47 provided at a lower end of the connecting arm 30, and the actuating component 35 is provided on the connecting arm 30 of the trigger 11. Besides, the operating portion 47 comprises a gripping portion 47*a* and a blocking portion 47*b* preventing fingers gripping on the gripping portion 47*a* from sliding downwards, as shown in FIG. 5A.

Further, the handle 21 comprises a first portion 21*a* having a first end connected to the spray gun body 2; a second portion 21*b* separated from the first portion 21*a* by a distance; and a connecting portion 21*c* connecting a second end of the first portion 21*a* with a first end of the second portion 21*b*. The second end of the second portion 21*b* is provided with a blocking portion 21*d*, and this blocking portion 21*d* is used to prevent the fingers gripping the second portion 21*b* from sliding upwards. Gun body 2, handle 21 and handle parts 21*a*, 21*b*, 21*c* and 21*d* are preferably made in one piece, particularly the part can be manufactured by forging.

Since the trigger 11 having a single connecting arm 30 is used, during the process of assembling the trigger 11 to the spray gun body 2, the installation inconvenience in the prior art that two arm portions of the U-shaped arm should be aligned to two installation holes on the spray gun body and meanwhile the hole of the actuating component should be aligned to the paint needle so that the installation can be completed is overcome, that is, the installation and dismantling convenience is improved.

Besides, the spray gun body 2 of the spray gun 1 has a first surface 2*a* for installing the connecting arm and a second surface 2*b* opposite to the first surface 2*a*, wherein the first surface 2*a* is provided with a window 14 so as to expose the paint needle 10 and the puller 17, and the second surface 2*b* is in an integral bulk-shape so as to sign corresponding picture, character and so on, for example, Logo or trademark and the like of a company, so that the spray gun seems more pleasing.

Figure 6A:
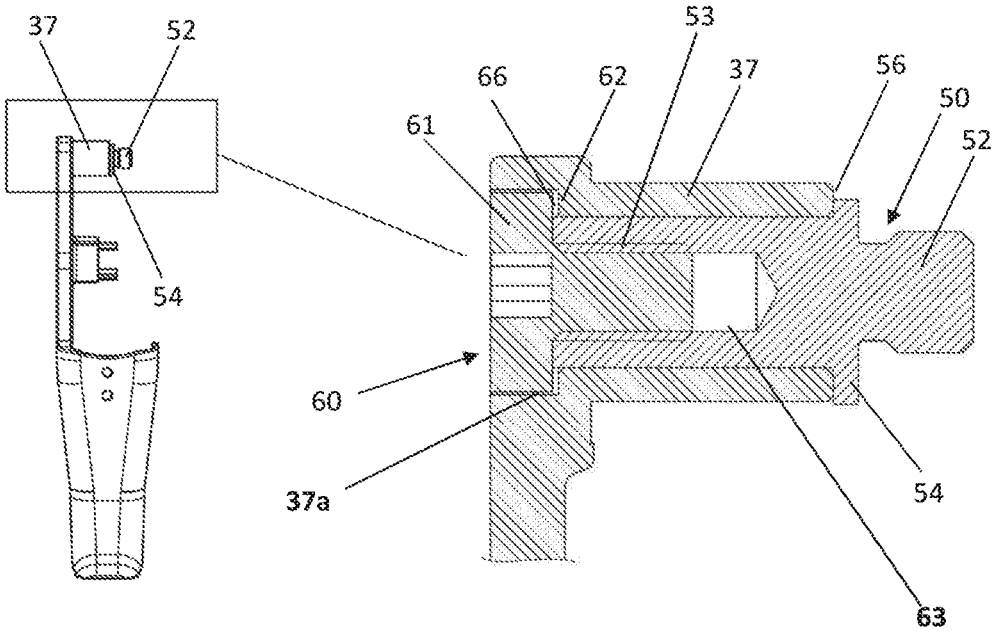
FIG. 6A is an enlarged diagram of sectional view showing one example of a manner of assembling the trigger as shown in FIG. 5A to a spray gun body.
Figure 7A:
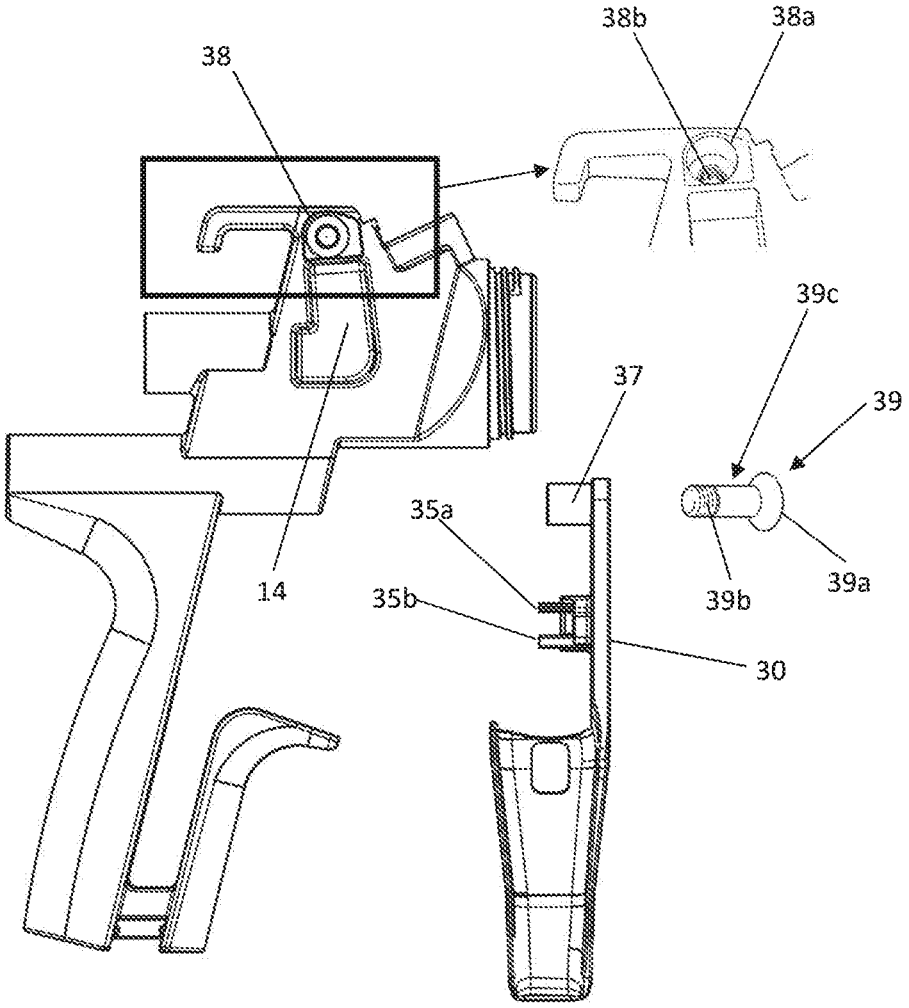
FIG. 7A is an enlarged diagram showing yet another example of a manner of assembling the trigger as shown in FIG. 5A to the spray gun body according to the disclosure.

Specifically, as shown in FIGS. 4A and 4B, FIG. 5A and FIG. 5B, the trigger 11 comprises: the single connecting arm 30 secured to the left side or the right side of the spray gun body 2 of the spray gun 1; the operating portion 47 provided at a lower end of the connecting arm 30; the actuating component 35 provided on the connecting arm 30; an installation sleeve 37 provided at an upper end of the connecting arm 30; and a fastening means (for example, shown by a box in FIG. 4A) passing through the installation sleeve 37 and used to pivotably secure the trigger 11 onto the spray gun body 2, wherein FIG. 6A and FIG. 7A specifically show the composition of the fastening means, and the fastening means will be specifically described below with reference to FIG. 6A and FIG. 7A.

Further as shown in FIGS. 4A and 4B, FIG. 5A and FIG. 5B, the actuating component 35 comprises a first extension element 35*a* and a second extension element 35*b* extending from the connecting arm 30, and a gap is defined between the first extension element 35*a* and the second extension element 35*b* so as to make the paint needle 10 pass through. Specifically, after the trigger 11 is assembled onto the spray gun body 2 of the spray gun 1, parts of the connecting arm 30 provided with the first extension element 35*a* and the second extension element 35*b* cover the window 14, and the paint needle 10 passes through the gap defined between the first extension element 35*a* and the second extension element 35*b*, so that when the trigger 11 is operated to spray the paint, the first extension element 35*a* and the second extension element 35*b* can push the puller 17 so as to make the paint needle 10 to be moved toward a direction away from the paint nozzle, thus leaving a seat in the paint nozzle, and then the paint nozzle is opened, so that the paint in a paint channel can flow out of the paint nozzle.

Besides, although FIG. 4A and FIG. 5A show that the first extension element 35*a* and the second extension element 35*b* extend perpendicularly to the connecting arm 30 and are parallel to each other, i.e. a gap defined between the first extension element 35*a* and the second extension element 35*b* is uniform, preferably and advantageously, the first extension element 35*a* and the second extension element 35*b* extend perpendicularly to the connecting arm 30 in a manner of non-parallel to each other, the gap between the first extension element 35*a* and the second extension element 35*b* is gradually decreased towards the puller 17, that is, the gap between the first extension element 35*a* and the second extension element 35*b* is gradually increased as being away from the puller 17. With such configuration, a moving space of the paint needle 10 can be increased, so that the paint needle 10 can be protected against damage caused by collision of the paint needle 10 with the first extension element 35*a* or the second extension element 35*b*.

The trigger 11, particularly the connecting arm 30, may have a recess 31 in its lateral surface, preferably on an inner surface and preferable around the first extension element 35*a* and the second extension element 35*b*. By that, material can be saved and the trigger 11 becomes lighter.

Figure 5C:
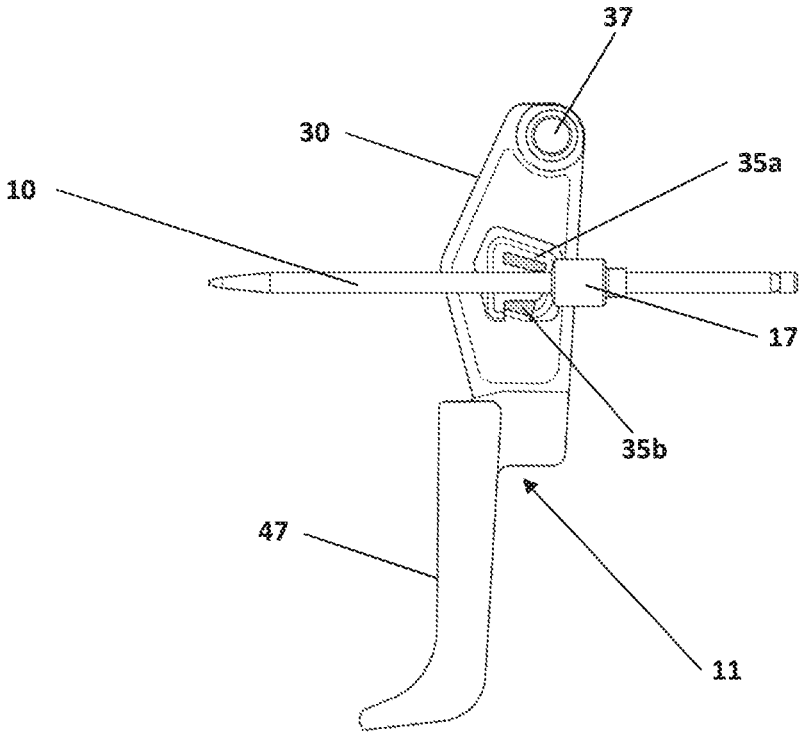
FIG. 5C is a side view of the trigger with paint needle with the gun body being removed according to an embodiment of the disclosure when the trigger is not activated.

Preferably, a width of the first extension element 35*a* is different from an extending width of the second extension element 35*b*, as shown in FIG. 5C. More preferably, the extension element of the first extension element 35*a* and the second extension element 35*b* close to the operating portion 47 of the trigger 11 has a smaller width, that is, the extending width of the second extension element 35*b* is smaller than the extending width of the first extension element 35*a*. The reason for that is the following: The trigger is moving along a circular path section when it is activated, as it is rotationally fixed to the spray gun body at one point. By that, the lower part of the trigger is moving along a longer way than the upper part of the trigger. If the extension elements would have the same width, as the lower extension element moves along a longer way than the upper extension element, the length of the window in the gun body would have to be bigger in its lower area than in its upper area, to provide the lower extension element enough space for its movement. By that the lower extension element is smaller in width than the upper extension element, the window in the gun body may have a rectangular shape. Preferably, the extension element having the smaller width is thicker than the extension element having with the bigger width to ensure that the stability of the extension element is sufficient.

Figure 6B:
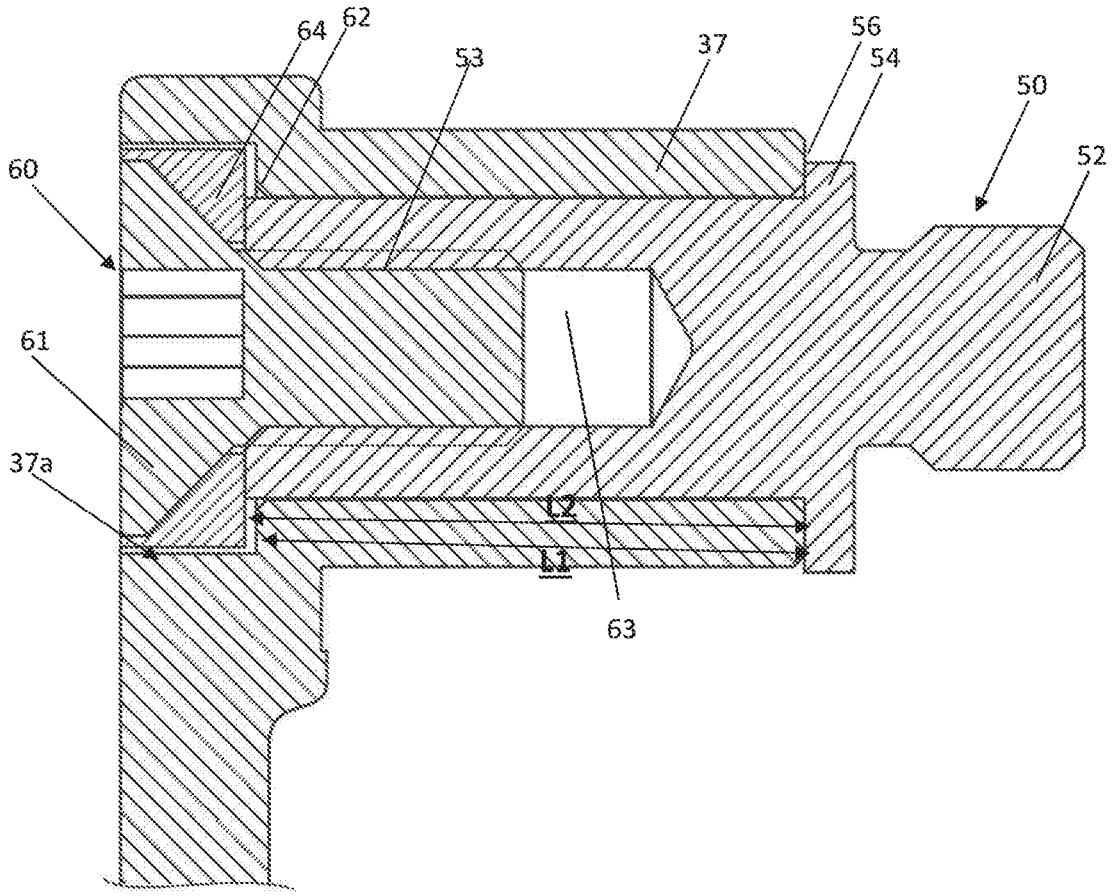
FIG. 6B is an enlarged diagram of sectional view showing another example of a manner of assembling the trigger as shown in FIG. 5A to a spray gun body.
Figure 6C:
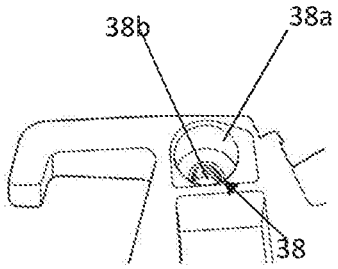
FIG. 6C is a diagram showing an installation hole provided on the spray gun body according to the disclosure for assembling the trigger as shown in FIG. 5A.

Besides, the spray gun body 2 is provided with an installation hole 38 (as shown in FIG. 6C) for the installation sleeve 37 and the fastening means to be inserted thereinto so as to pivotably secure the trigger 11 onto the spray gun body 2. Further, as shown in FIG. 6C, the installation hole 38 comprises a first section 38*a* having a first diameter and a second section 38*b* having a second diameter smaller than the first diameter. A step is formed between the first section 38*a* and the second section 38*b*.

Next, various examples of composition of the fastening means used for assembling the trigger 11 onto the spray gun body 2 is described with reference to FIGS. 6A and 6B and FIG. 7A.

Example 1

As shown in FIG. 6A, the fastening means comprises: a first fastening element 50, comprising a circumferential collar 54 and a threaded portion 52 provided at a first end of the first fastening element 50 and a threaded hole 53 internally opened towards a second end of the first fastening element 50, wherein the threaded portion 52 is fastened into the second section 38*b* of the installation hole 38 of the spray gun body 2; a second fastening element 60, having a rod portion 63 and a head portion 61, wherein the rod portion 63, which preferably has an outer thread, of the second fastening element 60 matches the threaded hole 53 of the first fastening element 50 so as to make the second fastening element 60 to be co-axially fixed and connected with the first fastening element 50, and the head portion 61 of the second fastening element 60 presses against the second end of the first fastening element 50, wherein the installation sleeve 37 is sleeved outside the first fastening element 50 and the second fastening element 60, and is arranged between the head portion 61 of the second fastening element 60 and the circumferential collar 54. The fixing element 60 may be for example a cylinder head screw or a hexagon head screw.

Alternatively, the fastening means further can comprise a ring 64, and the ring 64 is sandwiched between the head portion 61 of the second fastening element 60 and the second end of the first fastening element 50 and presses against the second end of the first fastening element 50, as shown in FIG. 6B. In this case, the fixing element 60 can for example be a counterhead screw.

Besides, the installation sleeve 37 has a first end provided on the connecting arm 30 and a second end against which the circumferential collar 54 abuts, and a distance L2 from the second end of the first fastening element 50 to the second end of the installation sleeve 37 is bigger than a distance L1 from the first end of the installation sleeve 37 to the second end of the installation sleeve 37. Or in other words, a distance L2 from the second end of the first fastening element 50 to the circumferential collar 54 of the first fastening element 50 is bigger than a distance L1 from the first end of the installation sleeve 37 to the second end of the installation sleeve 37.

A recess 37*a* is provided on the connecting arm 30 so that the rod portion 62 of the second fastening element 60 passes through the recess 37*a* to be thereby fastened into the threaded hole 53 of the first fastening element 50, and the head portion 61 of the second fastening element 60 is arranged in the recess 37*a*.

Besides, the first fastening element 50, the second fastening element 60 and the ring 64 are fixed against each other, and the installation sleeve 37 is rotatable with respect to these components as a whole.

There is a gap between the first end of the installation sleeve 37 provided on the connecting arm 30 and an end of the ring 64 abutting against the second end of the first fastening element 50.

Through the above-mentioned structure, the second end of the first fastening element 50 is enabled to protrude into the recess 37*a* of the connecting arm 30, thus a gap 66 can be established between a surface 62 of the first end of the installation sleeve 37 and the head portion 61 or the ring 64, so as to allow the first fastening element 50, the second fastening element 60 and the ring 64 to act as a whole to be rotatable with respect to the installation sleeve 37, or, as the the first fastening element 50, the second fastening element 60 and the ring 64 as a whole are fixed in the gun body, the installation sleeve 37 and the trigger 11, to which the installation sleeve 37 is attached, are rotatable with respect to these components as a whole.

The installation sleeve 37 can be formed in one piece with the operating portion 47 and the connecting arm 30 of the trigger 11, and the circumferential collar of the first fastening element 50 abuts against a surface 56 of the second end of the installation sleeve 37.

For the above-mentioned structure, in the situation that the threaded portion 52 of the fastening means is screwed into the second section 38*b* of the installation hole 38 of the spray gun body 2, meanwhile the installation sleeve 37 is received in the first section 38*a*, when the trigger 11 is actuated, the connecting arm 30 having the installation sleeve 37 and the operating portion 47 are rotatable with respect to the first fastening element 50 and the second fastening element 60, so that the first extension element 35*a* and the second extension element 35*b* can push the puller 17 to move towards a direction away from the paint nozzle, so that the paint is sprayed out of the paint nozzle.

Example 2

Figure 7B:
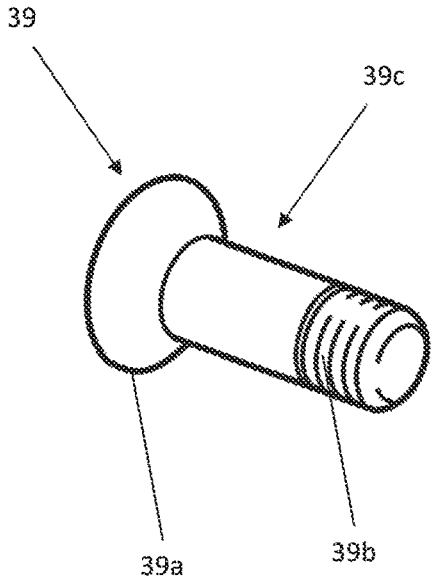
FIG. 7B is an enlarged diagram showing the screw provided in the FIG. 7A.

As shown in FIGS. 7A and 7B, the fastening means is a fastening screw 39, comprising: a rod portion 39*c* received in the installation sleeve 37; a head portion 39*a* located at one end of the rod portion 39*c* and having a diameter bigger than the rod portion 39*c*; and a threaded portion 39*b* located at the other end of the rod portion 39*c* and having a diameter smaller than the rod portion 39*c*, the threaded portion 39*b* being fastened into the second section 38*b* of the installation hole 38, and the installation sleeve 37 being received in the first section 38*a* of the installation hole 38. The length of the fastening screw 39 is such that the installation sleeve 37 is not tightly fixable in the installation hole 38, but even is the fastening screw 39 is pulled tight, the installation sleeve 37 and the trigger 11 are still able to rotate around the fastening screw 39.

When the trigger 11 is mounted onto the spray gun body 2, the first extension element 35*a* and the second extension element 35*b* are located in front of the puller 17, so that when the trigger 11 is actuated, the first extension element 35*a* and the second extension element 35*b* push the puller 17 backwards to open the nozzle.

Figure 8:
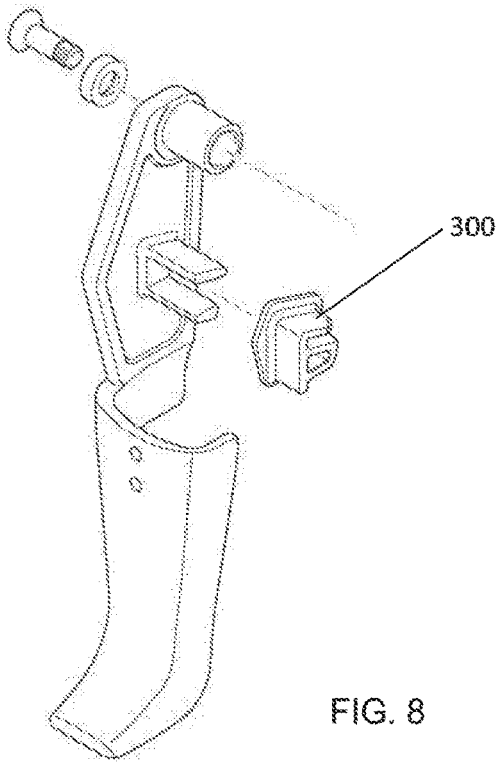
FIG. 8 is an assembling diagram showing a protective element and the trigger comprised in the spray gun according to the disclosure.

Besides, in the above-mentioned example, the first extension element 35*a* and the second extension element 35*b* can be covered by a protective element 300 so as to push the puller through the protective element 300, as shown in FIG. 8. The material of the protective element 300 may be a soft material, for example, plastic and so on. By that, the puller can be protected against collision and damages caused by the first extension element and the second extension element made from a hard material, thus prolonging the service life of the spray gun.

Figure 5D:
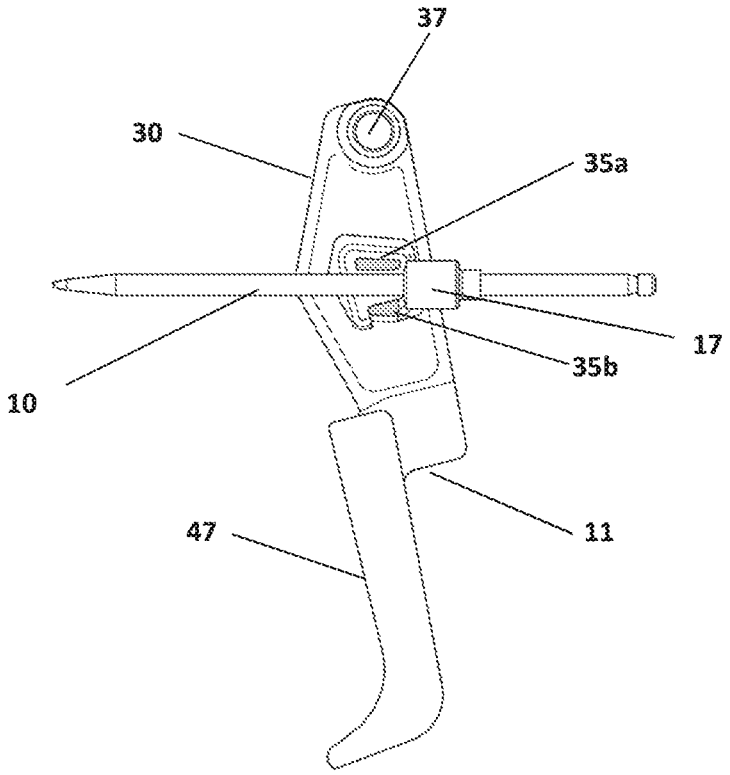
FIG. 5D is a side view of the trigger with paint needle with the gun body being removed when the trigger is activated.

Further, as it can be seen in FIGS. 5C and 5D, when the trigger is not activated, the puller is in contact with the upper first extension element 35*a*, when the trigger is activated, the puller is in contact with the upper first extension element 35*a* as well as with the lower second extension element 35*b* or even just with the lower second extension element 35*b*. This change from the first to the second extension element generates a sound and the user feels the change when activating the trigger. With the protective element 300, as the surface of the protective element 300 that is in contact with the puller is rounded, activation of the trigger is smoother and more uniform.

It is noted that in Example 1 and Example 2 provided above, when the trigger 11 is actuated to spray the paint, the blocking portion 47*b* of the trigger 11 and the blocking portion 21*b* of the handle are aligned to each other, so that the trigger 11 can be conveniently and easily operated so as to spray the paint.

Although the trigger described above is described taking the structure of the spray gun (FIG. 4A) provided in the disclosure as an example, the above-mentioned trigger also can be applied to sprays with other structures, which can be easily designed by those ordinarily skilled in the art after reading the present application, and details will not be given herein.

For the descriptive purpose, a plurality of improvements on the disclosure are described through several embodiments above. However, those skilled in the art should understand that various above improvements on the disclosure absolutely can be independently applied to the spray gun, and it is unnecessary to combine all the features to use.

The descriptions above are only preferable examples of the application, which are not used to restrict the disclosure. For those skilled in the art, the disclosure may have various changes and variations. Any modifications, equivalent substitutions, improvements etc. within the spirit and principle of the disclosure shall all be included in the scope of protection of the disclosure.

What is claimed is:

1. A trigger for a spray gun, said trigger comprising:

one and only one connecting arm, secured to one and only one of a left side or a right side of a spray gun body of the spray gun;

an operating portion, provided at a lower end of the connecting arm;

an actuating component, provided on the connecting arm;

an installation sleeve monolithically attached to an upper end of the connecting arm of the trigger, the upper end of the connecting arm being located above the operating portion, the installation sleeve being inserted into an installation hole in the spray gun body, and the installation hole including a first section having a first diameter and a second section having a second diameter that is smaller than the first diameter; and a fastening means, passing through the installation sleeve, used to pivotably secure the trigger onto one and only one of the left side or the right side of the spray gun body, wherein the installation sleeve and the connecting arm are formed in one piece, the fastening means comprises a first fastening element having a threaded portion that is fastened into the second section of the installation hole, and the installation sleeve is sleeved outside the first fastening element and is received in the first section of the installation hole.

2. The trigger for a spray gun according to claim 1, wherein the first fastening element comprises a fastening screw, the fastening screw comprising:

a rod portion;

a head portion located at one end of the rod portion and having a diameter bigger than the rod portion; and the threaded portion located at another end of the rod portion and having a diameter smaller than the rod portion.

3. The trigger for a spray gun according to claim 1, wherein the first fastening element has a circumferential collar, the fastening means further comprises a second fastening element, the second fastening element being co-axially fixed and connected with the first fastening element; and the installation sleeve is sleeved outside the first fastening element and the second fastening element, and is arranged between a head portion of the second fastening element and the circumferential collar with a clearance along an axial direction.

4. The trigger for a spray gun according to claim 3, wherein:

the circumferential collar and the threaded portion of the first fastening element are located at a first end of the first fastening element, the first fastening element internally has a threaded hole opened towards a second end of the first fastening element; and the second fastening element has a rod portion and the head portion, the rod portion of the second fastening element matches the threaded hole of the first fastening element, and the head portion of the second fastening element presses against the second end of the first fastening element.

5. The trigger for a spray gun according to claim 4, wherein the fastening means further comprises a ring, the head portion of the second fastening element presses against the second end of the first fastening element in a manner of the ring being sandwiched between the head portion of the second fastening element and the second end of the first fastening element.

6. The trigger for a spray gun according to claim 5,
wherein the first fastening element, the second fastening element, and the ring are fixed against each other, and
the installation sleeve is rotatable with respect to the first fastening element, the second fastening element, and the ring as a whole.

7. The trigger for a spray gun according to claim 4, wherein the installation sleeve has a first end monolithically attached to the connecting arm and a second end against which the circumferential collar abuts, and a distance from the second end of the first fastening element to the second end of the installation sleeve is bigger than a distance from the first end of the installation sleeve to the second end of the installation sleeve.

8. The trigger for a spray gun according to claim 4, wherein the connecting arm is provided with a recess to receive the head portion of the second fastening element.

9. The trigger for a spray gun according to claim 1, wherein the actuating component comprises a first extension element and a second extension element extending from the connecting arm, and a gap is defined between the first extension element and the second extension element.

10. The trigger for a spray gun according to claim 1, wherein the upper end of the connecting arm is secured to one and only one of the left side or the right side of the spray gun body.

11. A spray gun comprising:
a spray gun body,
a paint needle,
a puller secured to the paint needle, and
the trigger according to claim 1,
wherein the paint needle is movably arranged inside the spray gun body, and
the actuating component of the trigger is configured to push the puller so as to move the paint needle.

12. The spray gun according to claim 11, wherein the fastening means is a fastening screw, the fastening screw comprising:
a rod portion, received in the installation sleeve;
a head portion located at one end of the rod portion and having a diameter bigger than the rod portion; and
a threaded portion located at another other end of the rod portion and having a diameter smaller than the rod portion, the threaded portion being fastened into the second section of the installation hole.

13. The spray gun according to claim 11, wherein the fastening means comprises:
a first fastening element, having a circumferential collar and a threaded portion used to be fastened into the second section of the installation hole;
a second fastening element, the second fastening element being co-axially fixed and connected with the first fastening element; and
the installation sleeve, sleeved outside the first fastening element and the second fastening element, and arranged between a head portion of the second fastening element and the circumferential collar with a clearance along an axial direction.

14. The spray gun according to claim 11, wherein the actuating component comprises a first extension element and a second extension element extending from the single connecting arm, and a gap is defined between the first extension element and the second extension element so as to make the paint needle pass therethrough.

15. A trigger for a spray gun, said trigger comprising:
one and only one connecting arm for securing the trigger to one and only one of a left side or a right side of a spray gun body of the spray gun;
an operating portion provided at a lower end of the connecting arm;
at least one extension element extending from the connecting arm, the at least one extension element configured to, when the trigger is operated, move a paint needle of the spray gun;
an installation sleeve monolithically attached to an upper end of the connecting arm of the trigger, the upper end of the connecting arm being located above the operating portion, the installation sleeve being inserted into an installation hole in the spray gun body, and the installation hole including a first section having a first diameter and a second section having a second diameter that is smaller than the first diameter; and
a fastener that passes through the installation sleeve, the fastener pivotably securing the trigger to one and only one of the left side or the right side of the spray gun body,
wherein the installation sleeve and the connecting arm are formed in one piece,
the fastener includes a threaded portion that is fastened into the second section of the installation hole,
the installation sleeve is sleeved outside the fastener and is received in the first section of the installation hole, and
the upper end of the connecting arm is secured to one and only one of the left side or the right side of the spray gun body.

16. The trigger for a spray gun according to claim 15, wherein the fastener is a fastening screw that includes a head portion and the threaded portion.

17. The trigger for a spray gun according to claim 15, wherein the fastener comprises first and second fastening elements that are connected together.

18. The trigger for a spray gun according to claim 17,
wherein the first fastening element has a circumferential collar,
the second fastening element is co-axially fixed and connected with the first fastening element, and
the installation sleeve is sleeved outside the first and second fastening elements, and is arranged between a head portion of the second fastening element and the circumferential collar with a clearance along an axial direction.

19. The trigger for a spray gun according to claim 15, wherein the at least one extension element comprises a first extension element and a second extension element extending from the connecting arm, and a gap is defined between the first extension element and the second extension element.

20. A trigger for a spray gun, said trigger comprising:
one and only one connecting arm for securing the trigger to one and only one of a left side or a right side of a spray gun body of the spray gun;
an operating portion provided at a lower end of the connecting arm;
at least one extension element extending from the connecting arm, the at least one extension element configured to, when the trigger is operated, move a paint needle of the spray gun;
an installation sleeve provided at an upper end of the connecting arm, which is located above the operating portion, the installation sleeve being inserted into an installation hole in the spray gun body, the installation hole including a first section having a first diameter and a second section having a second diameter that is smaller than the first diameter; and a fastener that passes through the installation sleeve, the fastener pivotably securing the trigger to one and only one of the left side or the right side of the spray gun body, wherein the installation sleeve and the connecting arm are formed in one piece, the fastener includes a threaded portion that is fastened into the second section of the installation hole, the installation sleeve is sleeved outside the fastener and is received in the first section of the installation hole, the upper end of the connecting arm is secured to one and only one of the left side or the right side of the spray gun body, the fastener comprises first and second fastening elements that are connected together, the first fastening element has a circumferential collar, the second fastening element is co-axially fixed and connected with the first fastening element, the installation sleeve is sleeved outside the first and second fastening elements, and is arranged between a head portion of the second fastening element and the circumferential collar with a clearance along an axial direction, the circumferential collar and the threaded portion of the first fastening element are located at a first end of the first fastening element, the first fastening element internally has a threaded hole opened towards a second end of the first fastening element, the second fastening element has a rod portion and the head portion, the rod portion of the second fastening element matches the threaded hole of the first fastening element, and the head portion of the second fastening element presses against the second end of the first fastening element, and the connecting arm is provided with a recess to receive the head portion of the second fastening element.

* * * * *